US010697645B2

(12) United States Patent
Kim

(10) Patent No.: US 10,697,645 B2
(45) Date of Patent: Jun. 30, 2020

(54) COOKING APPARATUS AND TOUCH SENSOR ASSEMBLY FOR COOKING APPARATUS

(71) Applicant: LG ELECTRONICS INC., Seoul (KR)

(72) Inventor: Jihyun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 340 days.

(21) Appl. No.: 15/547,406

(22) PCT Filed: Jan. 28, 2016

(86) PCT No.: PCT/KR2016/000937
§ 371 (c)(1),
(2) Date: Jul. 28, 2017

(87) PCT Pub. No.: WO2016/126050
PCT Pub. Date: Aug. 11, 2016

(65) Prior Publication Data

US 2018/0274790 A1 Sep. 27, 2018

(30) Foreign Application Priority Data

Feb. 5, 2015 (KR) ..... 10-2015-0017972

(51) Int. Cl.
*A21B 1/00* (2006.01)
*H05B 3/68* (2006.01)
(Continued)

(52) U.S. Cl.
CPC ..... *F24C 7/086* (2013.01); *F24C 3/124* (2013.01); *F24C 15/06* (2013.01)

(58) Field of Classification Search
CPC ..... F24C 15/06; F24C 3/122; F24C 3/124; F24C 3/126; F24C 7/08; F24C 7/081;
(Continued)

(56) References Cited

U.S. PATENT DOCUMENTS 4,228,330 A * 10/1980 Larson ..... H01H 13/702 200/5 A
4,421,966 A * 12/1983 Pounds ..... H01H 13/702 200/302.1
(Continued)

FOREIGN PATENT DOCUMENTS

DE 102004005954 8/2005
EP 3037757 6/2016
(Continued)

OTHER PUBLICATIONS

International Written Opinion in International Application No. PCT/KR2016/000937, dated Jul. 27, 2016, 9 pages (with English translation).
(Continued)

*Primary Examiner* — Sang Y Paik
(74) *Attorney, Agent, or Firm* — Fish & Richardson P.C.

(57) ABSTRACT

Disclosed are a cooking apparatus and a touch sensor assembly. The touch sensor assembly according to an embodiment of the present invention includes an outer cover formed of a metallic material and configured to form a part of an exterior of the cooking apparatus; and a touch module installed to be in contact with a rear surface of the outer cover, and having a plurality of touch sensors, wherein a touching part which is formed by machining a rear surface of the outer cover which is in contact with the touch sensor, and easily elastically deformed when being touched by a user, and thus transfers a pressure to the touch sensor is formed.

19 Claims, 19 Drawing Sheets

(51) Int. Cl.
*F24C 7/08* (2006.01)
*F24C 3/12* (2006.01)
*F24C 15/06* (2006.01)

(58) Field of Classification Search
CPC ..... F24C 7/082; F24C 7/083; F24C 7/085; F24C 7/086
USPC ..... 219/443.1–468.2, 412
See application file for complete search history.

(56) References Cited

U.S. PATENT DOCUMENTS 6,967,299 B2 * 11/2005 Howie ..... H01H 13/702 200/296
7,435,932 B2 * 10/2008 Jung ..... H05K 3/0061 219/702
7,652,230 B2 * 1/2010 Baier ..... D06F 39/005 219/483
2006/0267962 A1 11/2006 Baier
2007/0045281 A1 3/2007 Baier
2016/0178276 A1 6/2016 Park

FOREIGN PATENT DOCUMENTS

JP 63118537 5/1988
JP 2006105472 4/2006
JP 2011033312 2/2011
KR 10-2003-0079363 10/2003
KR 20-0366745 10/2004

OTHER PUBLICATIONS

Extended European Search Report in European Application No. 16746791.9, dated Oct. 18, 2018, 9 pages.

* cited by examiner

[Fig. 1]
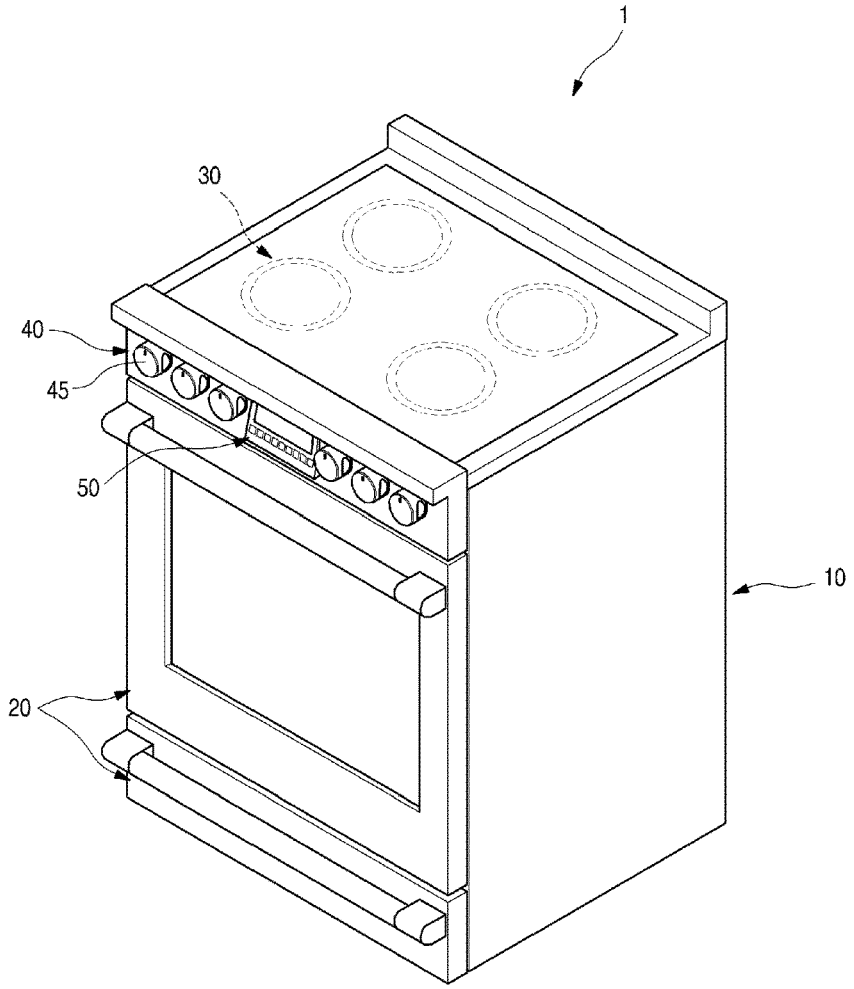
[Fig. 2]
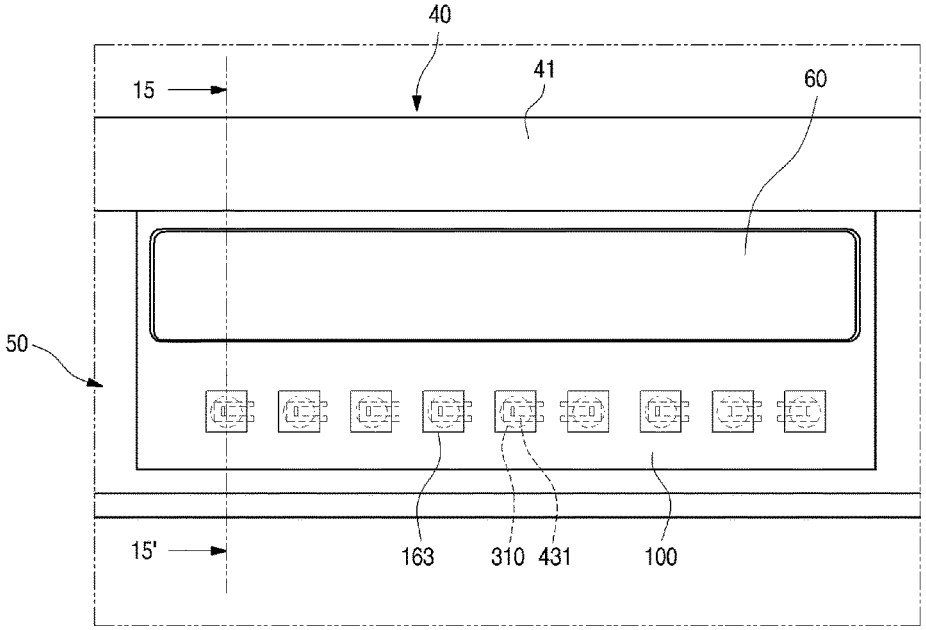

[Fig. 3]
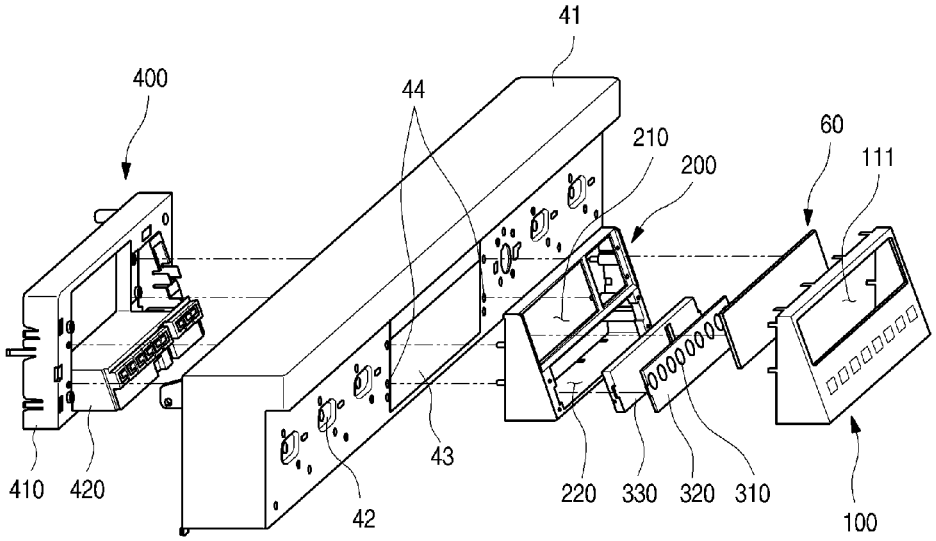
[Fig. 4]
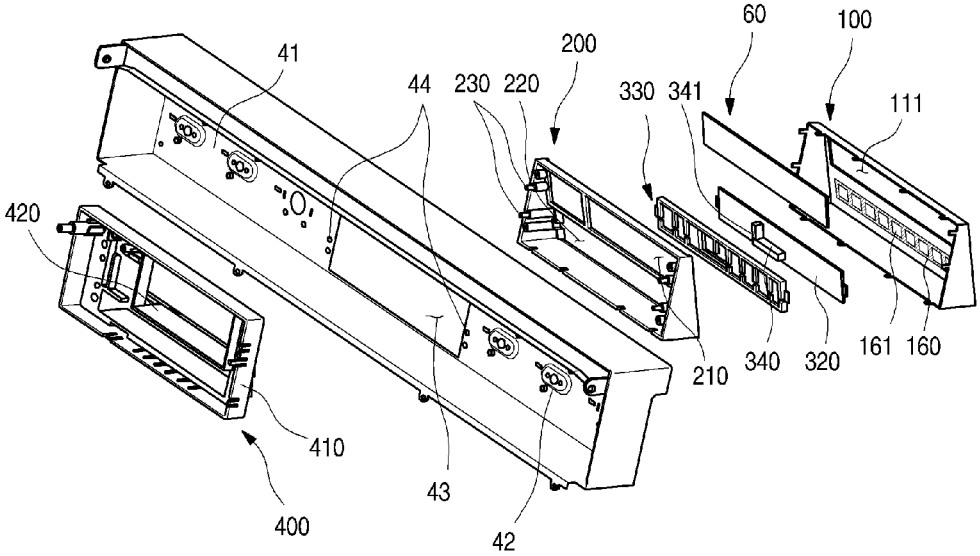

[Fig. 5]
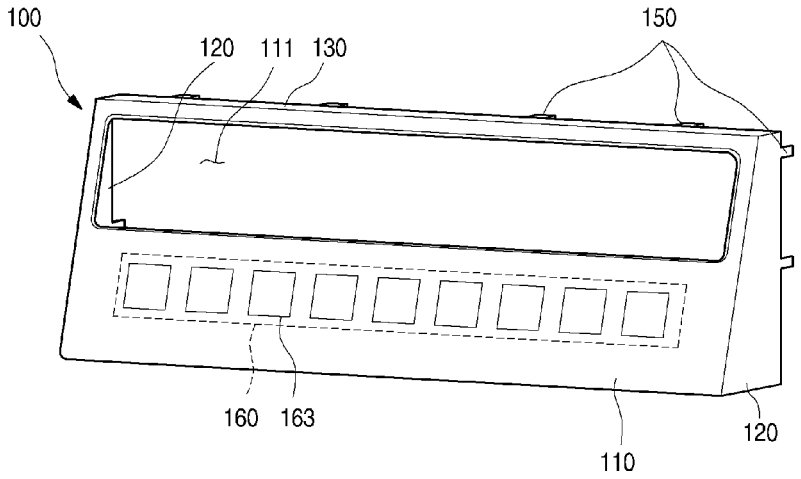
[Fig. 6]
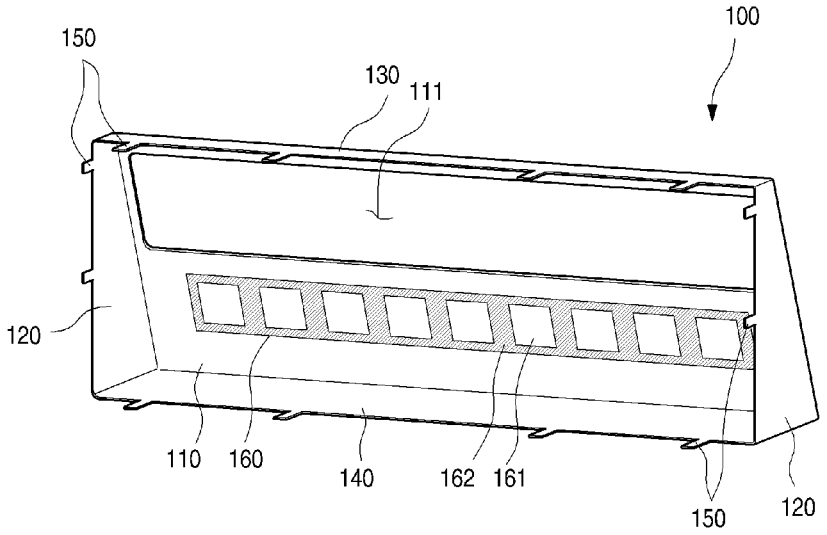

[Fig. 7]
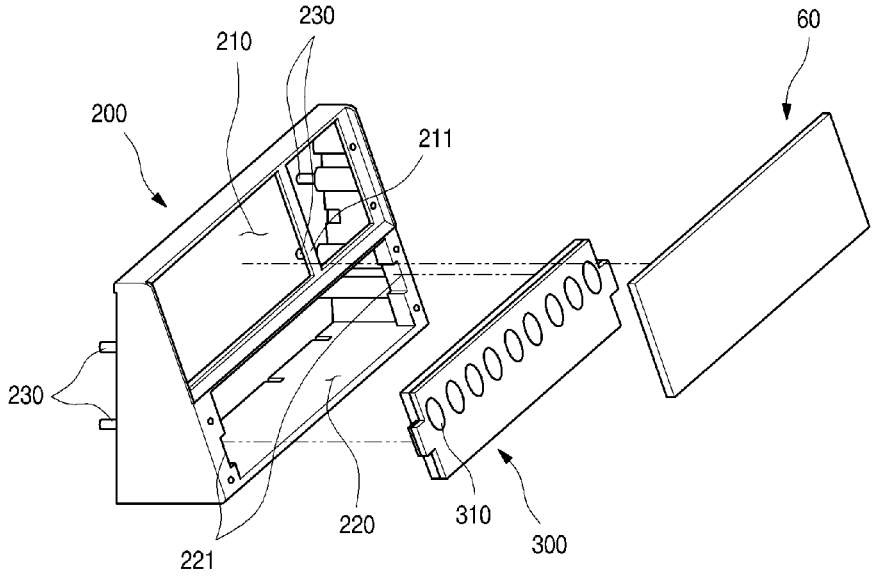
[Fig. 8]
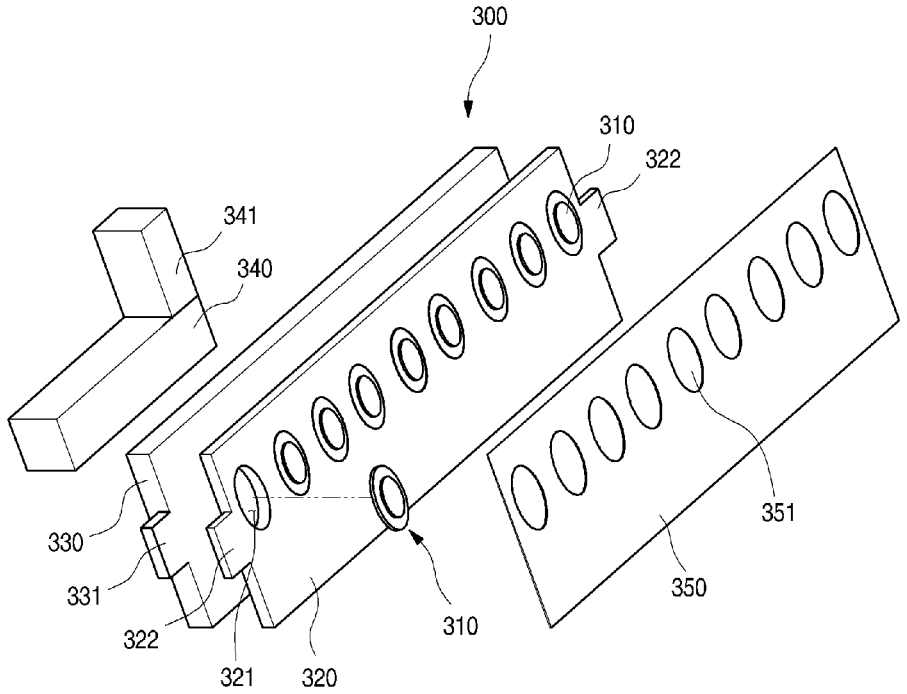

[Fig. 9]
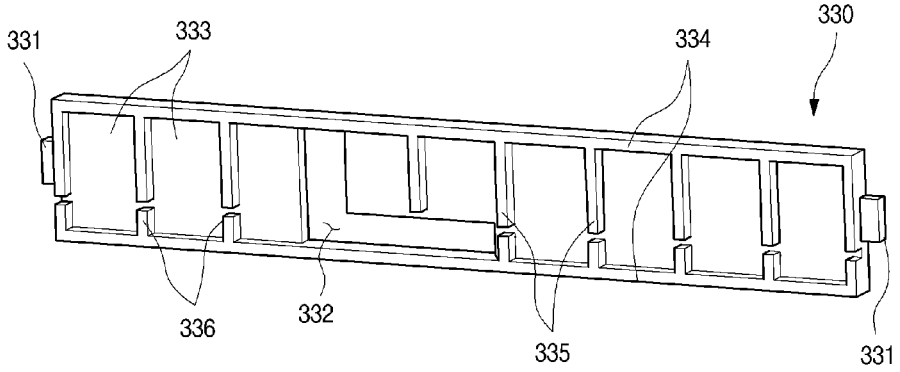
[Fig. 10]
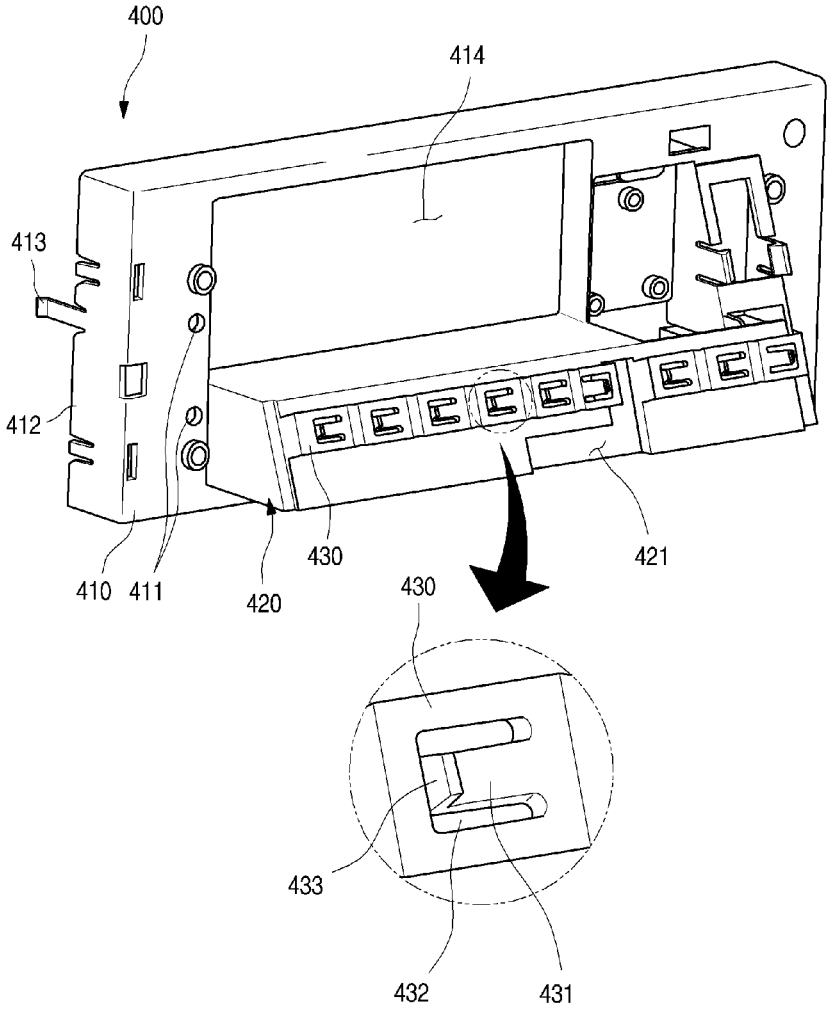

[Fig. 11]
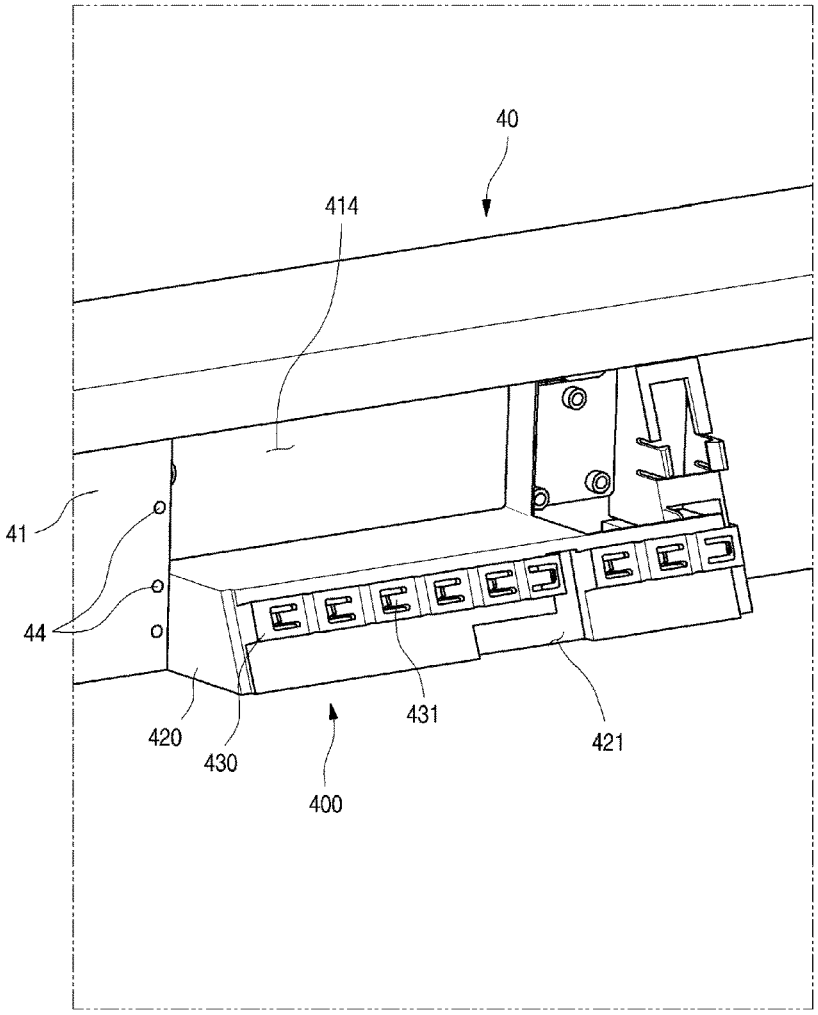
[Fig. 12]
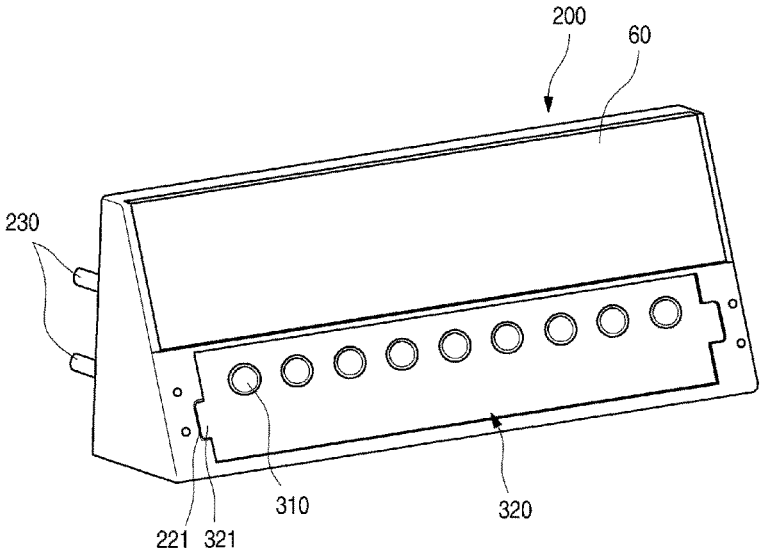

[Fig. 13]
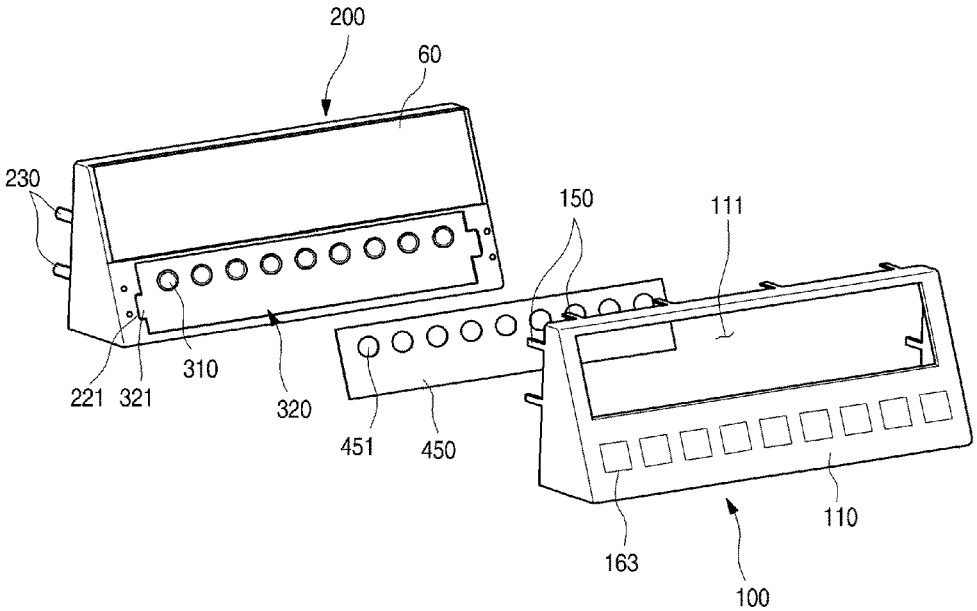
[Fig. 14]
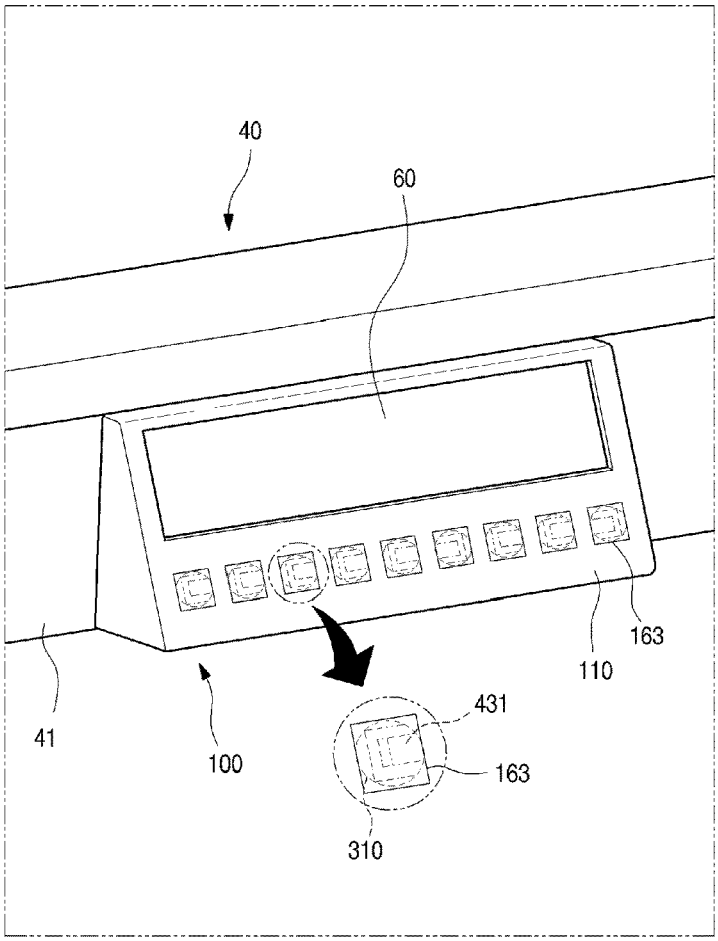

[Fig. 15]
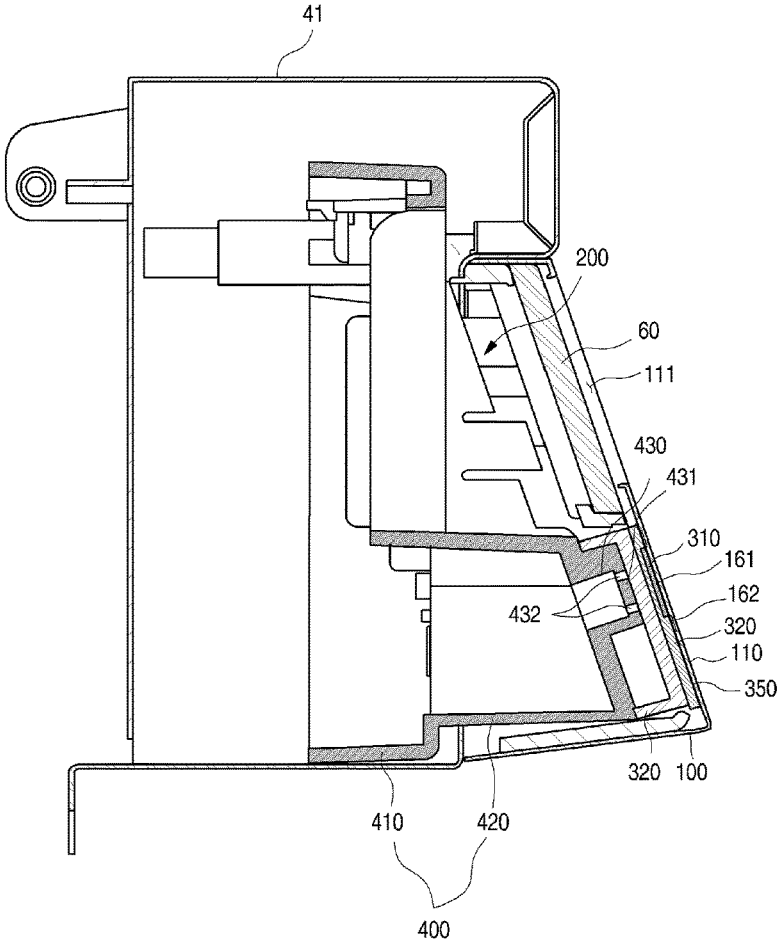
[Fig. 16]
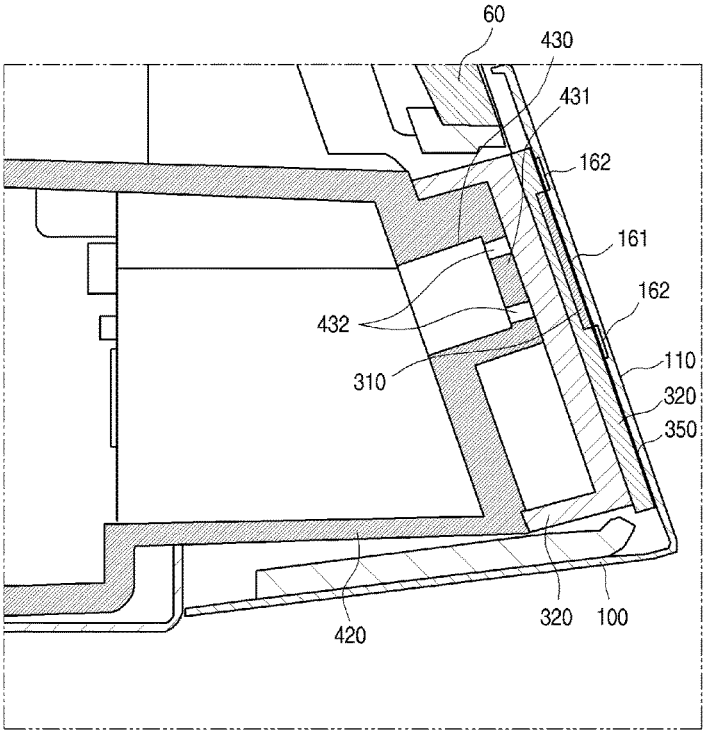

[Fig. 17]
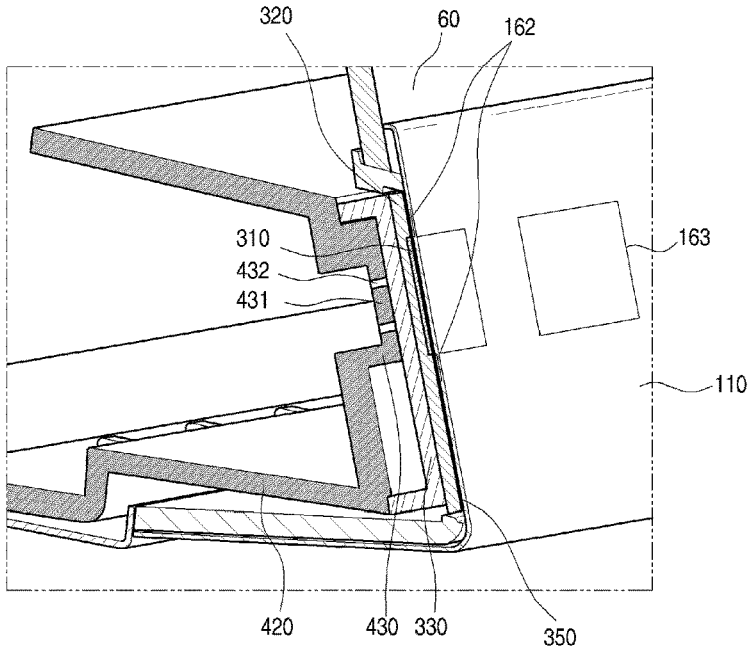
[Fig. 18]
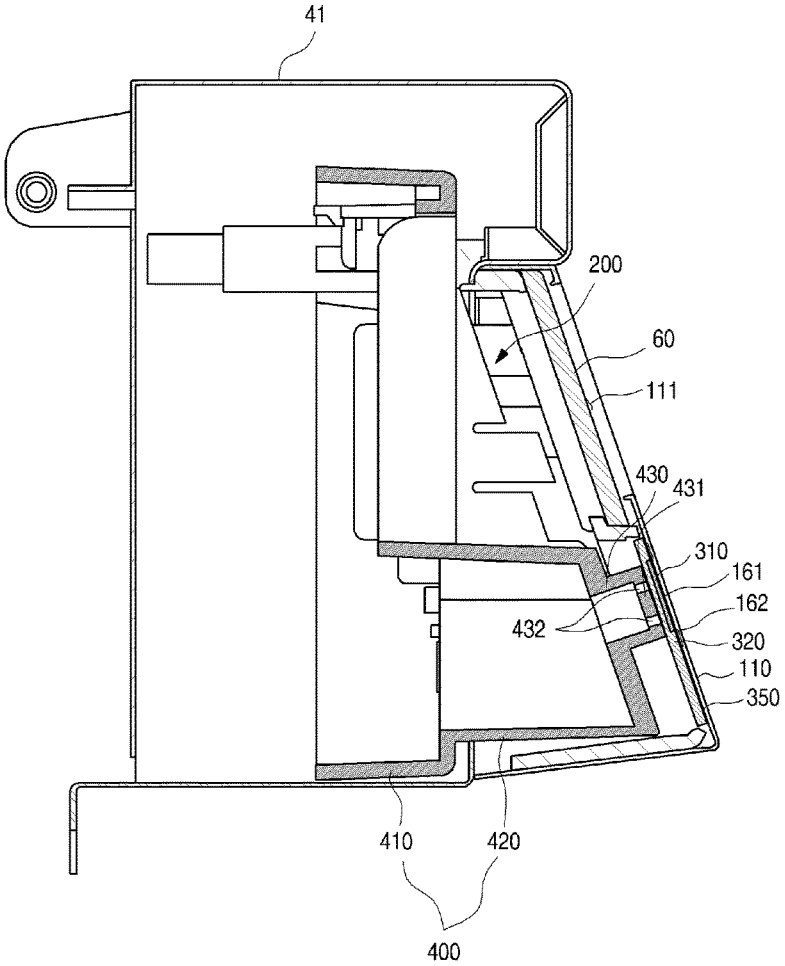

[Fig. 19]
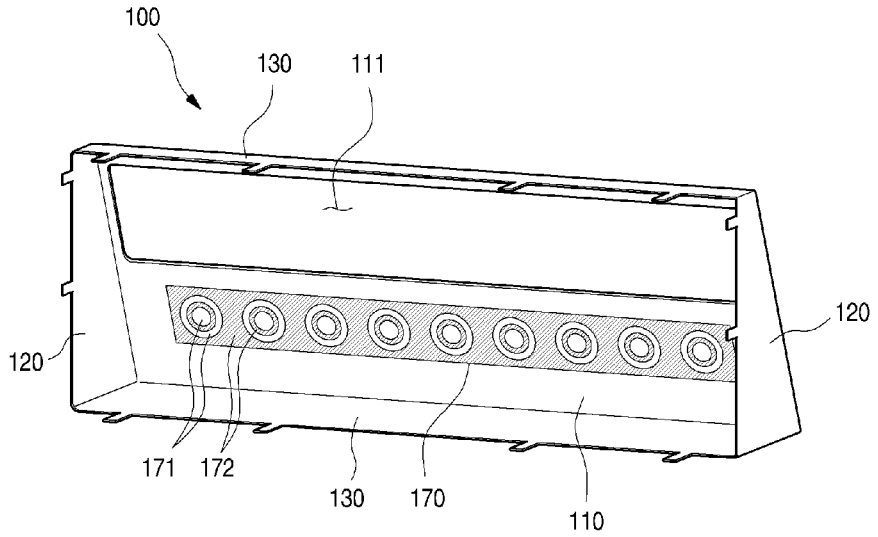
[Fig. 20]
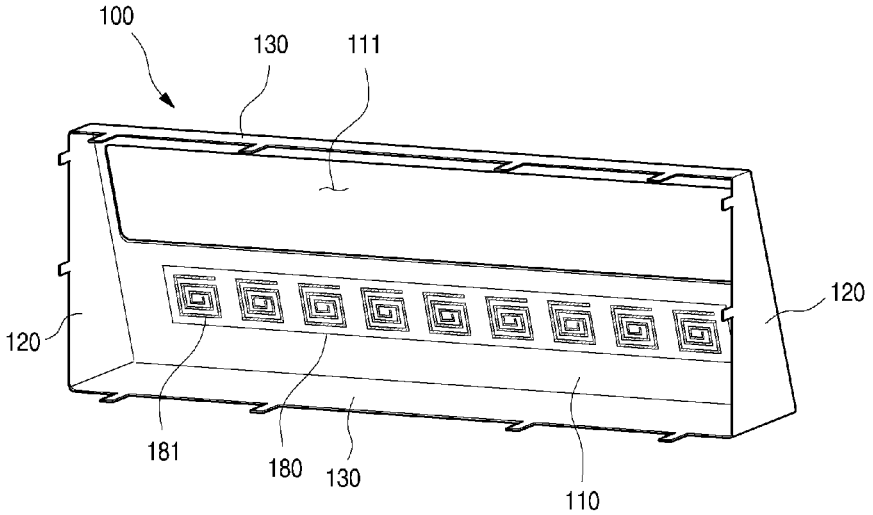

[Fig. 21]
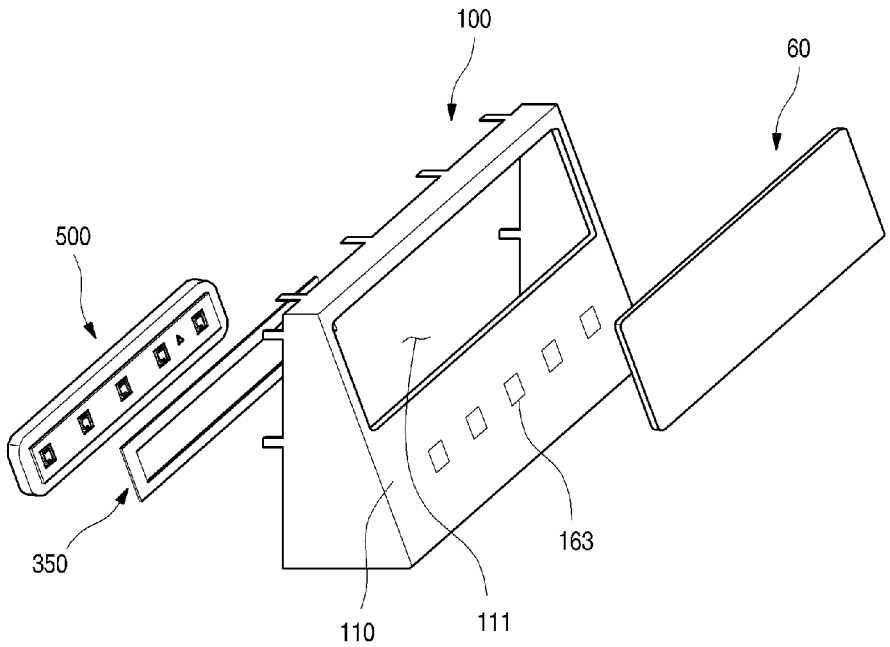

[Fig. 22]
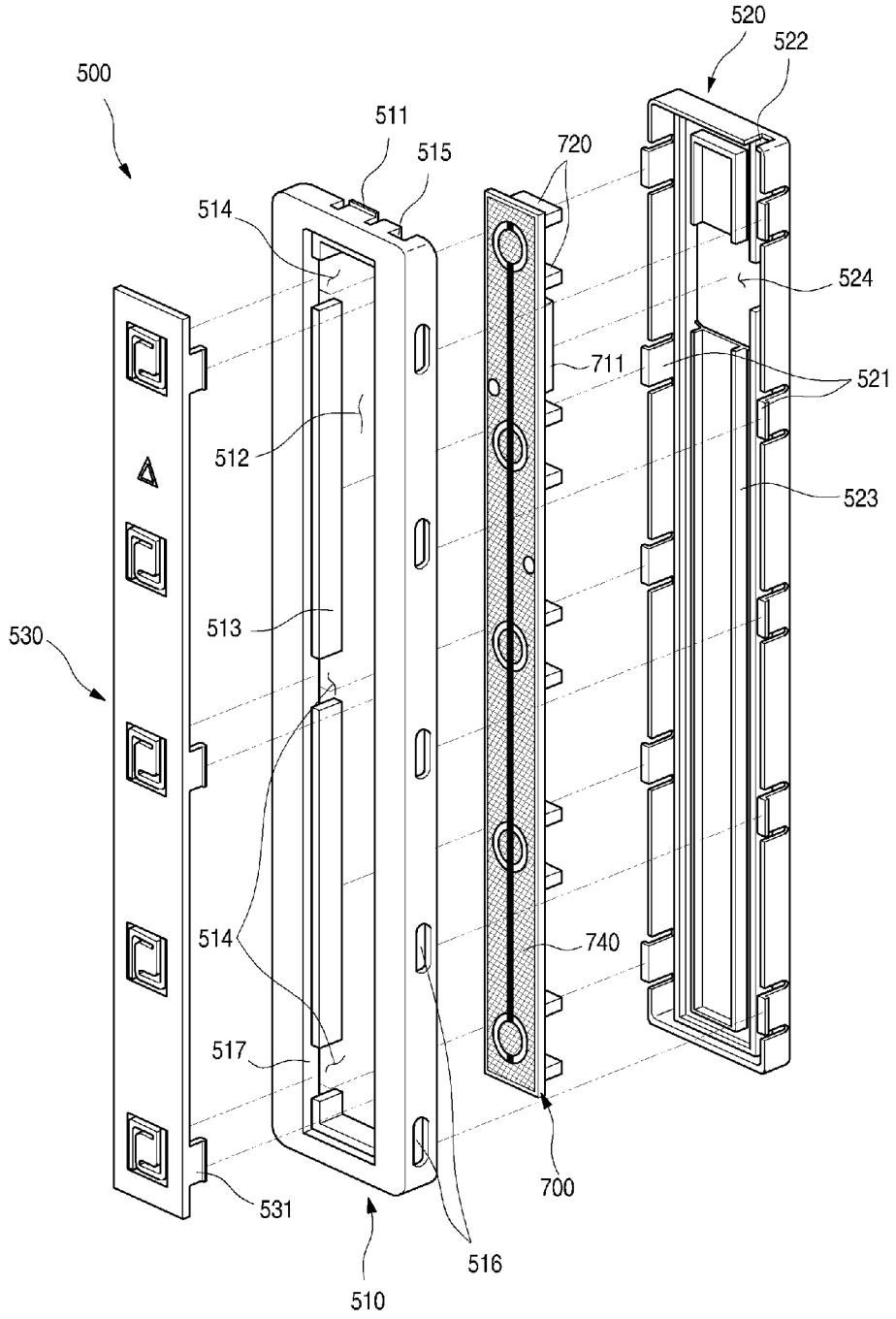

[Fig. 23]
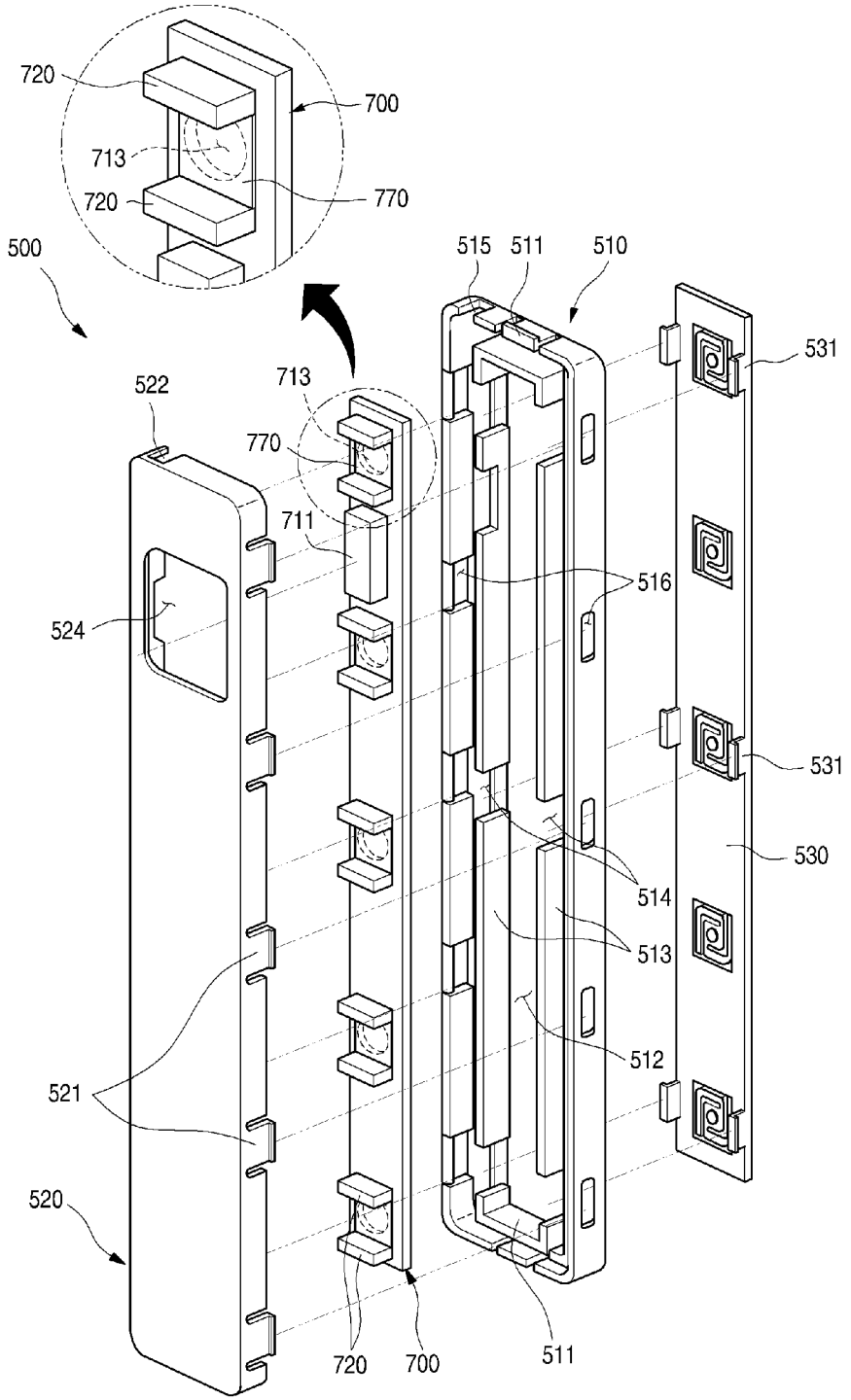

[Fig. 24]
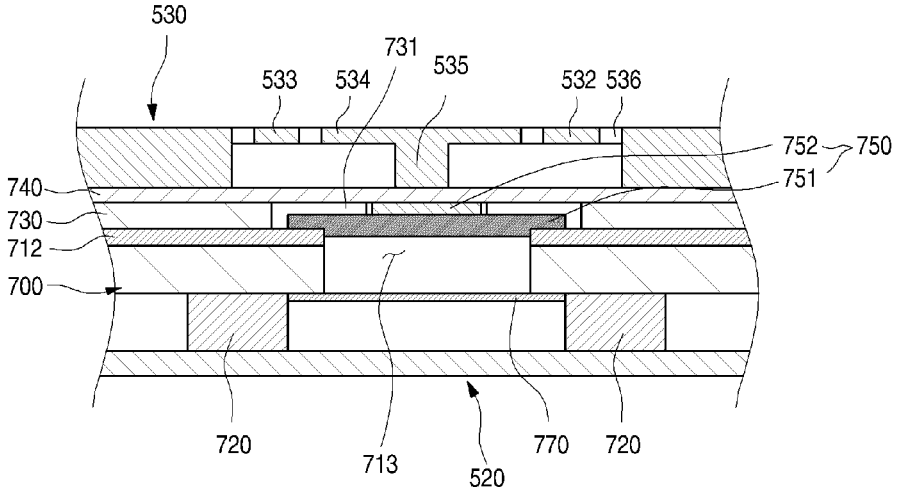
[Fig. 25]
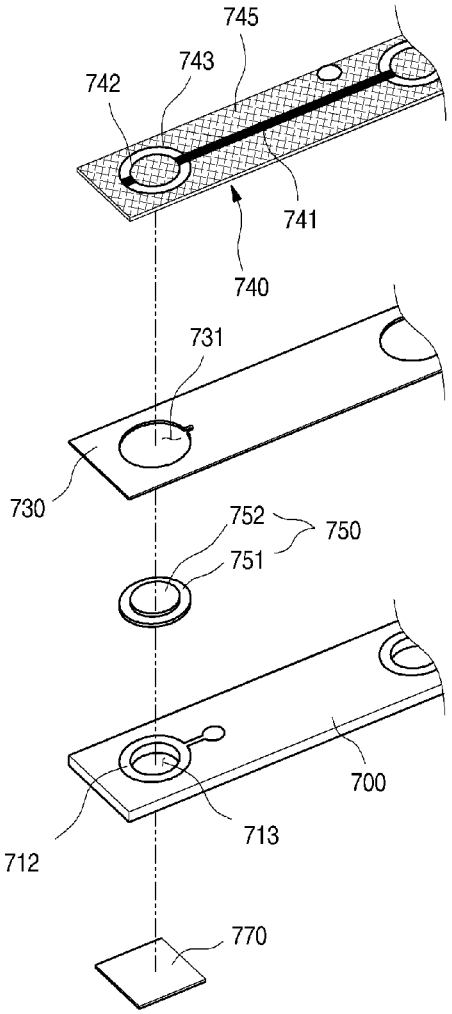

[Fig. 26]
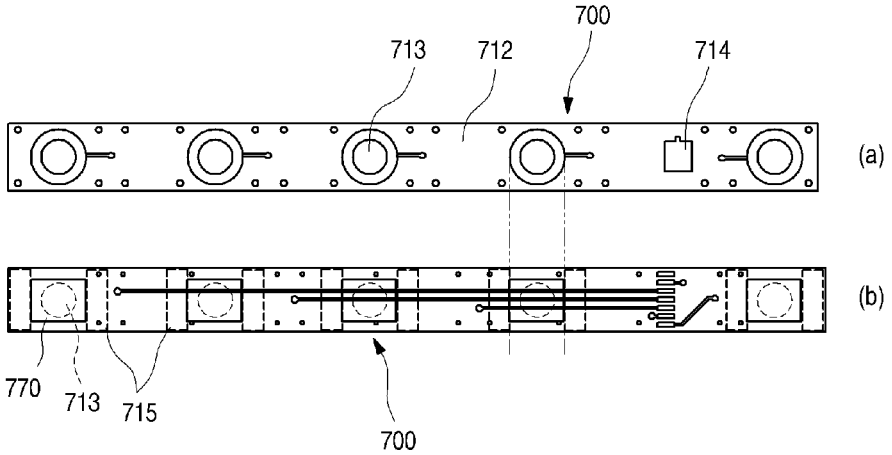
[Fig. 27]
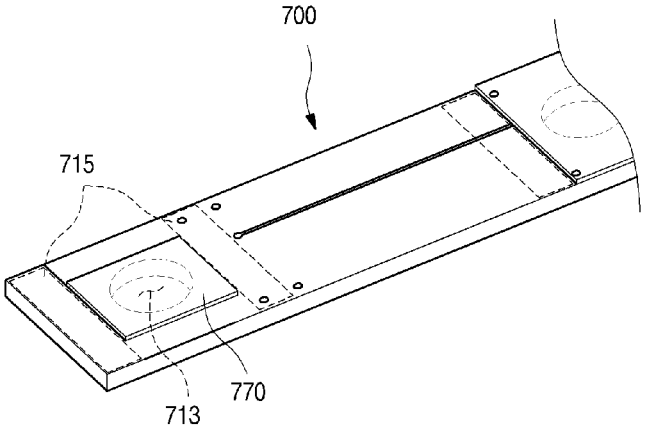
[Fig. 28]
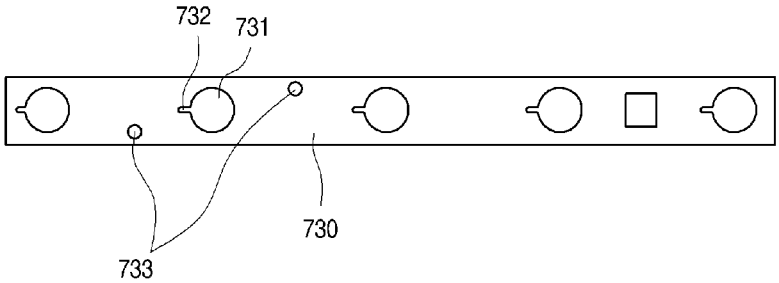

[Fig. 29]
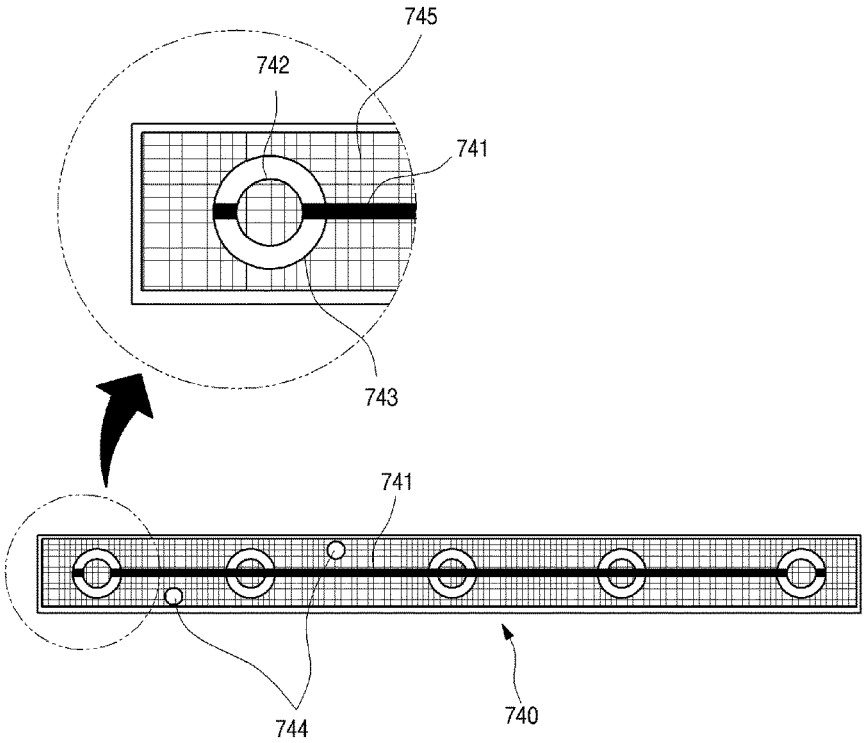
[Fig. 30]
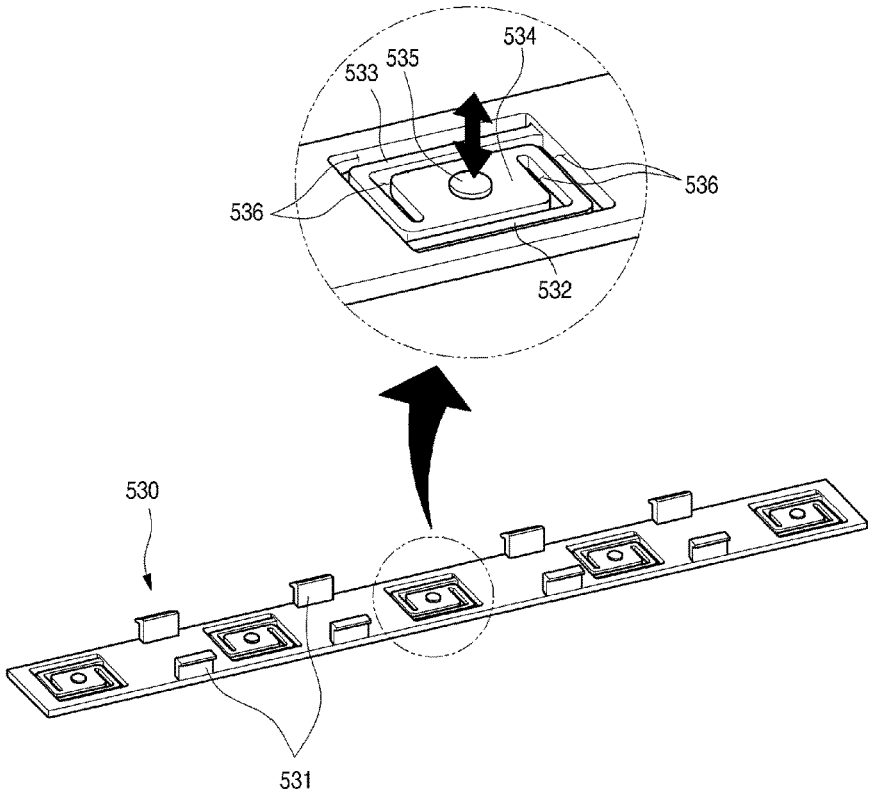

[Fig. 31]
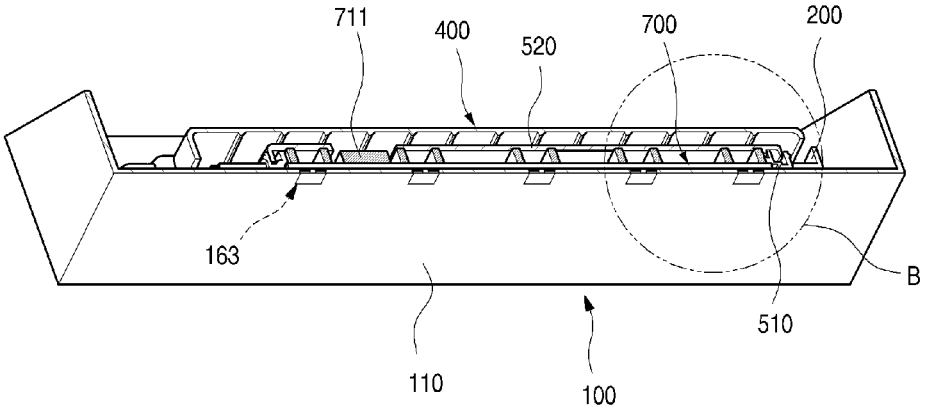
[Fig. 32]
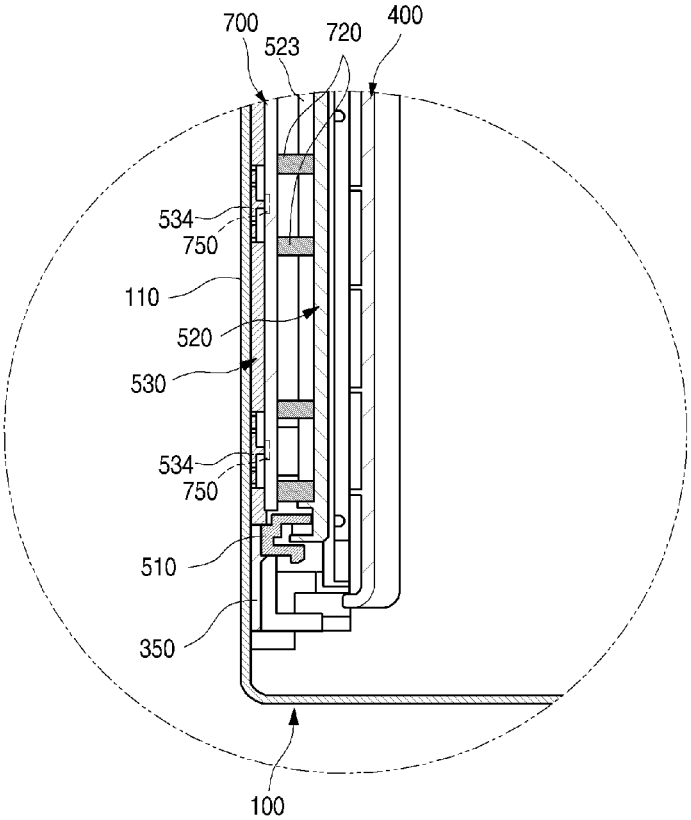

[Fig. 33]
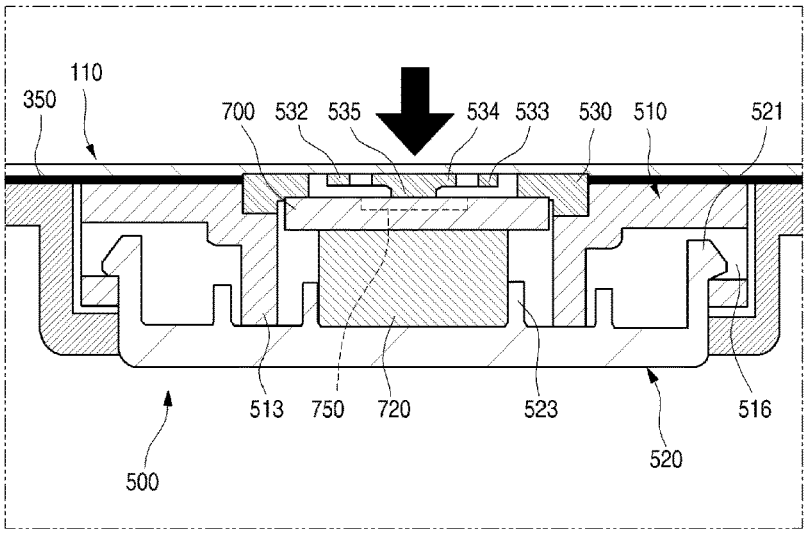
[Fig. 34]
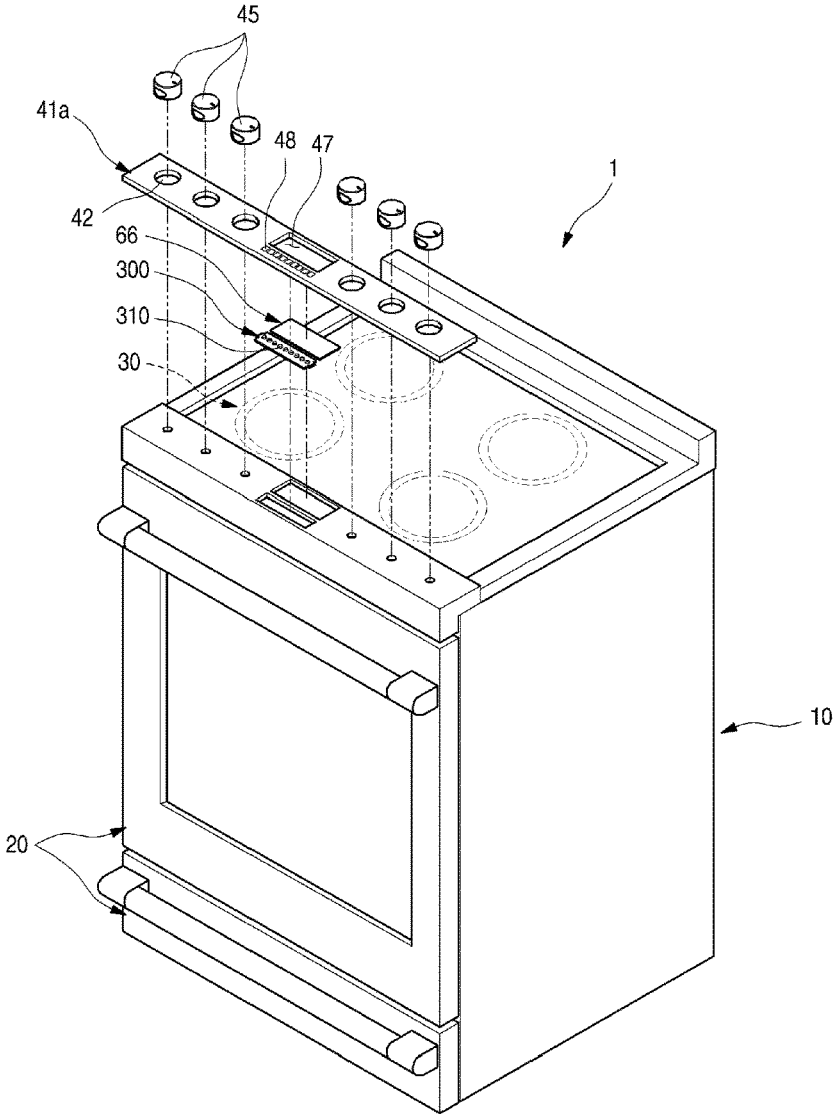

[Fig. 35]
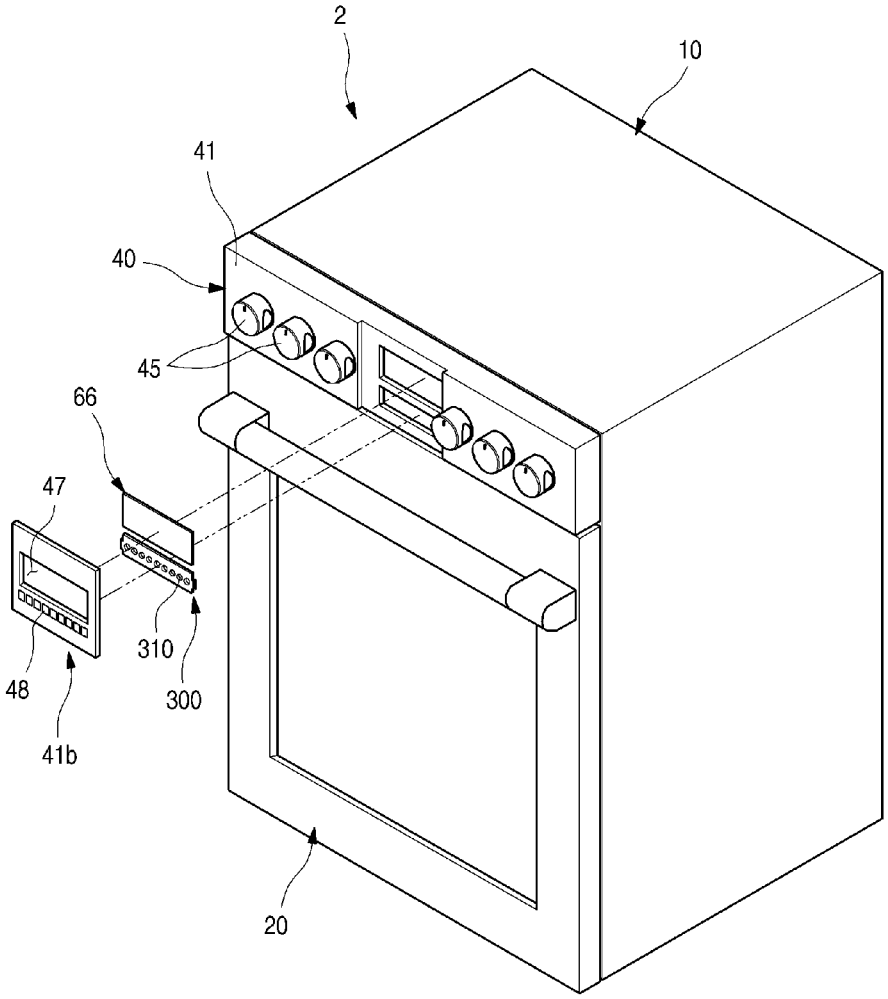

COOKING APPARATUS AND TOUCH SENSOR ASSEMBLY FOR COOKING APPARATUS

CROSS-REFERENCE TO RELATED APPLICATIONS

This application is a National Stage application under 35 U.S.C. § 371 of International Application No. PCT/KR2016/000937, filed Jan. 28, 2016, which claims the benefit of Korean Application No. 10-2015-0017972, filed on Feb. 5, 2015. The disclosures of the prior applications are incorporated herein by reference in their entirety.

TECHNICAL FIELD

The present invention relates to a cooking apparatus and a touch sensor assembly for the cooking apparatus.

BACKGROUND ART

Generally, a cooking apparatus is a home appliance which cooks food using gas or electric power. Such a cooking apparatus has an operation unit which operates the cooking apparatus, and various setting operations of the cooking apparatus may be performed through an operation of the operation unit.

Recently, a variety of food may be cooked using the cooking apparatus. To this end, a structure of the operation unit which may perform setting and operating of various functions has been developed. Representatively, in Korean Patent Publication No. 10-2009-0082624, there is disclosed a cooking apparatus in which a touch control panel is provided, and the setting and the operating of the various functions are performed in a touch met control panel of the cooking apparatus has a structure in which a capacitance-type keypad operated by touch is disposed at a rear surface of a glass panel.

In the case of such a control panel structure, there are some problems that an exterior of the control panel has no choice but to be formed of glass, and thus is restricted, and a sensor for a touch operation is also restricted to a capacitive sensor.

DISCLOSURE OF INVENTION

Technical Problem

The present invention is directed to providing a cooking apparatus in which an exterior thereof is improved by using a metallic material, and a recognition rate of a touch operation is also improved, and a touch sensor assembly for the cooking apparatus.

Also, the present invention is directed to providing a cooking apparatus in which an outer cover formed of a metallic material and formed so that an outside thereof is bent and a surface to be touched is inclined is easily deformed, and thus a recognition rate of a touch module provided at a rear surface of the outer cover is enhanced, and a touch sensor assembly for the cooking apparatus.

Also, the present invention is directed to providing a cooking apparatus in which a touch module is in close contact with an outer cover formed of a metallic material and having a surface to be operated by touch, and thus a recognition rate of a touch operation is enhanced, and a touch sensor assembly for the cooking apparatus.

Also, the present invention is directed to providing a cooking apparatus in which a touch module is able to be pressed and supported by an outer cover formed of a metallic material and having a surface to be operated by touch, and thus a recognition rate of a touch operation is enhanced, and a touch sensor assembly for the cooking apparatus.

Solution to Problem

One aspect of the present invention provides a touch sensor assembly of a cooking apparatus, including an outer cover formed of a metallic material and configured to form a part of an exterior of the cooking apparatus; and a touch module installed to be in contact with a rear surface of the outer cover, and having a plurality of touch sensors, wherein a touching part which is formed by machining a rear surface of the outer cover which is in contact with the touch sensor, and easily elastically deformed when being touched by a user, and thus transfers a pressure to the touch sensor is formed.

The touching part may be formed by machining a surface of the outer cover using etching or laser processing.

The touching part may be formed by machining a perimeter of the touching part, and a thickness of the touching part may be formed thicker than the perimeter of the touching part.

The touching part may be machined and formed in a plurality of concentric circular shapes having a center corresponding to a center of the touch sensor and having different diameters.

The touching part may be machined and formed in a spiral shape at a position corresponding to a center of the touch sensor.

An inclined part may be formed at a front surface of the outer cover to be inclined, and a perimeter of the inclined part may be bent so as to accommodate the touch module, and the touching part may be formed at a rear surface of the inclined part.

The touch sensor assembly may further include a guide case which is inserted into the outer cover formed to be bent, and is in close contact with the outer cover, and opened in a shape corresponding to the touch module, and thus has a touch module installation part in which the touch module is inserted.

An aligning groove and an aligning protrusion may be respectively formed at the touch module installation part and the touch module to have shapes corresponding to each other, such that the touch module is matched at a normal position.

The touch module may include a touch PCB at which the touch sensor is installed, and a touch control part which is installed at the touch PCB to process a signal of the touch sensor, and an elastic member which elastically supports the touch PCB may be further provided at one side of the touch PCB.

An opening in which the touch control part is accommodated may be formed at one side of the elastic member corresponding to the touch control part.

A plurality of partition parts may protrude from the elastic member, and a space part may be formed at a position of the touching part, and an air vent which is opened to discharge air inside the space part may be further formed at one side of the space part.

The touch sensor assembly may further include a guide case located at an inner side surface of the outer cover, and having a touch module installation part which is opened so that the touch module is installed; and a supporter coupled to the guide case and configured to protrude toward the touch module installation part so that the touch module is in close contact with the outer cover.

An outer plate which forms an exterior of the cooking apparatus may be provided between the guide case and the supporter, and the supporter and the guide case may be coupled by a fastening member which passes, in turn, through the supporter, the outer plate and the guide case.

A coupling piece which extends so as to be bent when being coupled to the guide case and to restrict an end of the guide case may be formed at an end of the outer cover.

The supporter may include a base which is restricted to the outer plate; and a protruding part which passes through an installation opening formed at the outer plate and then extends, and an end of the protruding part may support the touch module.

A touching part which elastically supports the touch module may be further formed at a position of the supporter corresponding to the touch sensor.

A cut-away part which is cut away along the touching part and provides elasticity to the touching part may be formed at a perimeter of the touching part.

A protrusion which protrudes toward the touch module may be further formed at one side of the touching part, and the protrusion may be located at a position corresponding to a center of the touch sensor.

A display window through which a display for displaying an operation and setting state of the cooking apparatus is exposed may be formed at the outer cover to be opened.

The outer cover may include a front surface at which the touching part is formed and which is formed to be inclined; and a side surface and upper and lower surfaces which are bent from outer ends of the front surface, and an open rear surface of the outer cover may be in contact with an outer surface of the cooking apparatus, and thus may be shielded.

Another aspect of the present invention provides a cooking apparatus including a main body configured to form a cooking space; an exterior member formed of a metallic material and configured to form at least a part of an exterior of the main body; a touch module installed at a rear surface of the exterior member so that a plurality of touch sensors are in close contact therewith; a plurality of indication parts formed at an exposing surface of the exterior member corresponding to each of positions of the plurality of touch sensors, and touched by a user; and a touching part machined and formed at an opposite surface of the indication part to allow the exterior member to be elastically deformed, and configured to be in contact with the touch sensor and to transfer a pressure to the touch sensor when being touched by the user.

The exterior member may include an outer plate which forms an exterior of a front surface or an upper surface of the main body.

The exterior member may include an outer cover which is installed at the main body and formed to be bent and to protrude from an outer surface of the main body.

An inclined surface which has the indication part and the touching part and with which the touch module is installed to be in close contact may be provided at the outer cover.

An operating knob which is rotated by the user may be further provided at the exterior member.

The touching part may be formed by machining a surface of the outer cover using etching or laser processing.

The touching part may be formed by machining a perimeter of the touching part, and a thickness of the touching part may be formed thicker than the perimeter of the touching part.

The touching part may be machined and formed in a plurality of concentric circular shapes having a center corresponding to a center of the touch sensor and having different diameters.

The touching part may be machined and formed in a spiral shape at a position corresponding to a center of the touch sensor.

Advantageous Effects of Invention

According to the proposed invention, since the exterior of the operation unit of the cooking apparatus is formed of a metallic material, and the operation can be input by directly touching the outer cover without a separate button structure, the entire exterior can be improved, and the convenience in the operation input can be enhanced.

Also, since the touching part formed by the etching or the laser processing is provided at the rear surface of the outer cover which is in contact with the touch sensor, the outer cover can be easily deformed when the outer cover is touched, and a change in the pressure can be easily transferred to the touch sensor, and thus the recognition rate of the touch sensor can be enhanced.

In particular, the perimeter of the outer cover is formed to be bent, and the touch operation can be smoothly recognized by the structure of the touching part even when a tension acting on an area close to the perimeter of the outer cover by the bending is applied.

Also, by molding of the touching parts, a plurality of keys are prevented from being input at the same time even when a plurality of touching parts are operated, and thus the plurality of touching parts can be independently input.

And the guide case can maintain the touch module in a state fixed at a normal position, and the touch sensor can be located at a position which coincides with the touching part by coupling between the outer case and the guide case, and thus assemblability and recognition performance of the touch operation can be enhanced.

And the touch sensor can be primarily fixed to the outer cover by the adhesive sheet, and the touch module is supported from a rear side thereof by the supporter, and the touch sensor can be maintained in the closely contacting state with the outer cover, and thus the recognition rate of the touch sensor can be enhanced.

And the touch sensor can be elastically supported by the elastic part formed at the supporter or the elastic member provided at the rear surface of the touch module. Therefore, when the pressure applied to the outer cover is released after the operation of the outer cover, the touch sensor and the outer cover can be returned to their original positions and states, and thus the operation thereof can be sequentially performed, and the recognition rate can be prevented from being lowered due to long-term use.

BRIEF DESCRIPTION OF DRAWINGS

FIG. 1 is a perspective view of a cooking apparatus according to a first embodiment of the present invention.

FIG. 2 is a front view of an operation unit according to the first embodiment of the present invention.

FIG. 3 is an exploded perspective view of the operation unit when being seen from a front thereof.

FIG. 4 is an exploded perspective view of the operation unit when being seen from a rear thereof.

FIG. 5 is a perspective view of an outer cover according to the first embodiment of the present invention, when being seen from a front thereof.

FIG. 6 is a perspective view of the outer cover when being seen from a rear thereof.

FIG. 7 is an exploded perspective view illustrating a coupling structure of a guide case, a display and a touch module according to the first embodiment of the present invention.

FIG. 8 is an exploded perspective view of the touch module according to the first embodiment of the present invention.

FIG. 9 is a perspective view of an elastic member according to the first embodiment of the present invention, when being seen from a rear thereof.

FIG. 10 is a perspective view of a supporter according to the first embodiment of the present invention.

FIG. 11 is a perspective view illustrating a state in which the supporter is coupled to an outer plate.

FIG. 12 is a perspective view illustrating a state in which the display and the touch module are coupled to the guide case.

FIG. 13 is an exploded perspective view illustrating a coupling structure between the guide case and the outer cover.

FIG. 14 is an partial perspective view illustrating a coupling structure between the outer plate and the outer cover.

FIG. 15 is a cross-sectional view taken along line 15-15' of FIG. 2.

FIG. 16 is an enlarged view of an A portion of FIG. 15.

FIG. 17 is a partially cut-away perspective view of the operation unit.

FIG. 18 is a cross-sectional view of an operation unit according to a second embodiment of the present invention.

FIG. 19 is a perspective view of an outer cover according to a third embodiment of the present invention.

FIG. 20 is a perspective view of an outer cover according to a fourth embodiment of the present invention.

FIG. 21 is an exploded perspective view of an operation unit according to a fifth embodiment of the present invention.

FIG. 22 is an exploded perspective view of a touch sensor assembly according to the fifth embodiment of the present invention.

FIG. 23 is an exploded perspective view of the touch sensor assembly when being seen from a rear thereof.

FIG. 24 is a longitudinal cross-sectional view of the touch sensor assembly.

FIG. 25 is an exploded perspective view illustrating a coupling structure of a touch sensor which is a main element of the touch sensor assembly.

FIG. 26 is a plan view and a rear view of a sensor PCB which is a main element of the touch sensor assembly.

FIG. 27 is a partial perspective view illustrating a state in which a shielding member is installed at the sensor PCB.

FIG. 28 is a plan view of a spacer which is a main element of the touch sensor assembly.

FIG. 29 is a plan view of a conductive foil which is a main element of the touch sensor assembly.

FIG. 30 is a rear perspective view of a touch booster which is a main element of the touch sensor assembly.

FIG. 31 is a cut-away perspective view of the operation unit.

FIG. 32 is an enlarged cross-sectional view of a B portion of FIG. 31.

FIG. 33 is a cross-sectional view illustrating a state in which the touch sensor assembly is installed.

FIG. 34 is an exploded perspective view of a cooking apparatus according to a sixth embodiment of the present invention.

FIG. 35 is an exploded perspective view of a cooking apparatus according to a seventh embodiment of the present invention.

MODE FOR THE INVENTION

Hereinafter, exemplary embodiments of the present invention will be described in detail with reference to the accompanying drawings. The invention may, however, be embodied in many different forms and should not be construed as being limited to the embodiments set forth herein; rather, that alternative embodiments included in other retrogressive inventions or falling within the spirit and scope of the present disclosure can easily be derived through adding, altering, and removing, and will fully convey the concept of the invention to those skilled in the art.

An example of a cooking apparatus according to the present invention in which an oven and a cook-top are integrally formed will be described. However, the cooking apparatus according to the present invention may be applied to all types of cooking apparatuses, such as a microwave oven, a gas stove and an oven, in which an operation unit is formed in a touch type. Hereinafter, for convenience of explanation and understanding, an example of the cooking apparatus having a structure in which the oven and the cook-top are integrally formed will be described.

FIG. 1 is a perspective view of a cooking apparatus according to a first embodiment of the present invention.

As illustrated in the drawing, a cooking apparatus 1 according to a first embodiment of the present invention may include a main body 10 having a cooking space formed therein, a door 20 which is provided at a front surface of the main body 10 to selectively open and close the cooking space, and a cook-top 30 which is provided at an upper portion of the main body 10 to cook food.

Specifically, the main body 10 is formed in a hexahedral shape, and may have two cooking spaces which are independently formed therein. Each of the cooking spaces is opened forward, and has the door 20 to be separately opened and closed.

An inside of each of the cooking spaces is formed to be heated by gas or electric power and thus to heat and cook the food accommodated therein, and the cooking spaces which are provided at upper and lower sides, respectively may be formed to be independently operated.

The door 20 may be rotated forward to be opened and closed. The door 20 which opens and closes the lower cooking space may be formed in a drawer type which is slidably inserted and withdrawn.

The cook-top 30 forms an upper surface of the cooking apparatus 1, and may be formed in a flat surface shape. And the cook-top 30 is formed so that a container for cooking is seated on an upper surface thereof and then heated. The cook-top 30 may have a sealed-type gas range which is heated by the gas, or may be heated by the electric power.

Meanwhile, an operation unit 40 may be formed at a front surface of the upper portion of the main body 10. The operation unit 40 serves to control an operation of the cooking spaces and the cook-top 30, and a plurality of operating knobs 45 which are operated in a rotary method may be installed.

The operation unit 40 may further include a touch sensor assembly 50 which is formed in a touch type to control an operation of the cooking apparatus 1. Of course, the operation unit 40 may be configured with only the touch sensor assembly 50 without the operating knobs 45.

Hereinafter, the operation unit 40 will be described, and particularly, the touch sensor assembly 50 forming the operation unit 40 will be described in detail.

FIG. 2 is a front view of the operation unit according to the first embodiment of the present invention. And FIG. 3 is an exploded perspective view of the operation unit when being seen from a front thereof. And FIG. 4 is an exploded perspective view of the operation unit when being seen from a rear thereof.

As illustrated in the drawings, an exterior of the operation unit 40 may be formed in a metallic material such as stainless steel, and may include an outer plate 41 which forms a part of the front surface of the main body 10, and an outer cover 100 which is installed at the outer plate 41 to be touched by a user.

The outer plate 41 corresponds to a left and right width of the main body 10, and is disposed at an upper end of the front surface of the main body 10. And the outer plate 41 is bent several times, and forms an exterior of the upper portion of the main body 10. A plurality of knob holes 42 are punched at both sides of the front surface of the outer plate 41, and the plurality of operating knobs 45 may be rotatably installed therein. An installation opening 43 in which the outer cover 100 touched by the user is installed is opened at a center portion of the outer plate 41.

That is, the operating knobs 45 and the outer cover 100 which are operated through the operation unit 40 are exposed forward, and may be disposed at a position at which the user can easily operate. The outer cover 100 is provided in a structure which protrudes from the outer plate 41, and thus may be further easily operated by the user.

A display 60 which displays an operation state of the cooking apparatus 1 and a setting for the operation of the cooking apparatus 1 is provided at a center of the operation unit 40, and a touch module 300 may be provided under the display 60. Therefore, through the touch sensor assembly 50 located at the center of the operation unit 40, the user may input the operation setting of the cooking apparatus 1 and may also check the operation state thereof.

At this time, the outer cover 100 forms the exterior of the operation unit 40, and has a structure which completely covers the touch module 300. Therefore, the touch module 300 is provided at a rear surface of the outer cover 100, and may be formed to enable an input and selection of the operation by directly touching the outer cover 100.

Meanwhile, based on the outer plate 41, a supporter 400 may be provided at a rear of the outer plate 41. The supporter 400 is coupled to a guide case 200 at which the touch module 300 and the display 60 are installed, and is formed to press and support the touch module 300.

The supporter 400 is coupled to the guide case 200 with the outer plate 41 being interposed therebetween. Specifically, a case coupling part 230 of the guide case 200 may pass through a coupling hole 44 of the outer plate 41, and may be coupled to a supporter coupling part 411.

And a fastening member, such as a screw, which is fastened from a rear of the supporter 400 may be fastened so as to pass through the supporter coupling part 411, the coupling hole 44 and the case coupling part 230, and thus the supporter 400, the outer plate 41 and the guide case 200 may be coupled to each other, and thus may be formed in one unit.

A display installation part 210 at which the display 60 is installed and a touch module installation part 220 at which the touch module 300 is installed are formed at the guide case 200. And the guide case 200 may be generally formed to further protrude forward gradually from an upper portion thereof toward a lower portion thereof, and a front surface thereof is formed in an inclined surface, and thus checking of the display 60 and inputting of the touch module 300 may be easily performed.

The display 60 and the touch module 300 are installed at a front surface of the guide case 200. In a state in which the display 60 and the touch module 300 are coupled to the guide case 200, the outer cover 100 is coupled so as to cover the front surface and a perimeter surface of the guide case 200.

The outer cover 100 is formed corresponding to the guide case 200, and forms the exterior of the operation unit 40. And a display window 111 is formed at the outer cover 100 so that the display 60 is exposed to an outside.

The outer cover 100 is formed to shield an outer surface of the guide case 200 except the display 60, and particularly to be in close contact with the touch module 300, such that an operating signal is input to the touch module 300 by touching the outer cover 100.

Meanwhile, if necessary, the outer cover 100 may be integrally formed with the outer plate 41. That is, the outer cover 100 may be formed by bending the outer plate 41 which is formed in a single component. At this point, a portion which protrudes forward by the bending and at which the touch module 300 and the display 60 are installed may be the outer cover 100, and a portion which forms the rest of the operation unit 40 may be the outer plate 41.

Hereinafter, each element forming the operation unit 40 will be described in detail with reference to the drawings.

FIG. 5 is a perspective view of the outer cover according to the first embodiment of the present invention, when being seen from a front thereof. And FIG. 6 is a perspective view of the outer cover when being seen from a rear thereof.

As illustrated in the drawings, the outer cover 100 is formed of the metallic material, and a perimeter surface thereof is formed to be bent and thus to cover the guide case 200. And the front surface of the outer cover 100 generally forms an inclined part 110 which is formed to be inclined, and is formed to have the same angle as that of the front surface of the guide case 200, and thus formed as a surface which is in contact with the front surface of the guide case 200. Both left and right side surfaces 120 of the outer cover 100 are formed to be bent backward, and each width thereof is gradually widened from an upper end of the inclined part 110 toward a lower end thereof. An upper surface 130 and a lower surface 140 of the outer cover 100 may have widths corresponding to those of the both left and right surfaces, and may be formed to be bent backward.

The open rear surface of the outer cover 100 may be formed in a quadrangular shape, and an end of the rear surface may be formed in parallel with the front surface of the outer plate 41. And a space in which the guide case 200 can be accommodated is provided inside the outer cover 100. A coupling piece 150 is formed at a perimeter of a rear end of the outer cover 100.

The coupling piece 150 is formed to further extend backward from the rear end of the outer cover 100, i.e., from ends of the left and right side surfaces and a lower surface of the outer cover 100. The coupling piece 150 is bent to be in contact with a rear end of the guide case 200 when the outer cover 100 is coupled with the guide case 200.

The coupling piece 150 extends so as to cover the rear end of the guide case 200 when being bent to be stably coupled with the guide case 200, and a plurality of coupling pieces 150 are provided at each surface so that the outer cover 100 is maintained in a closely contacting state with the outer surface of the guide case 200.

The display window 111 is formed at the inclined part 110 of the outer cover 100. The display window 111 is opened so that the display 60 is exposed to an outside. The display window 111 is formed long in a transverse direction, and thus a space in which a touch input part 160 for a touch operation is disposed is provided under the display window 111.

The touch input part 160 is further formed under the display window 111. The touch input part 160 is a portion which is touched by the user to set and operate the cooking apparatus 1. And the touch input part 160 may be formed at a position corresponding to a position of the touch module 300 so that the operating signal is input to the touch module 300 by the user's touch operation.

Meanwhile, the touch input part 160 may include a plurality of touching parts 161. The touching parts 161 are formed at the rear surface of the outer cover 100, and located at positions corresponding to a plurality of touch sensors 310 provided at the touch module 300. Therefore, when the outer cover 100 is installed, the touching parts 161 are located at positions which are in close contact with the touch sensors 310, respectively.

A machining part 162 is further formed at an area between an inside of the touch input part 160 and an outside of each of the touching parts 161. The machining part 162 is a portion in which an area between the plurality of touching parts 161 and an external area of the touch input part 160 are machined by etching or laser processing so that the plurality of touching parts 161 are separately disposed to be spaced apart from each other.

Therefore, a thickness of the machining part 162 may be formed to be thinner than a thickness of each of the touching parts 161 or the outside of the touch input part 160 by the etching or the laser processing. Therefore, when the touching parts 161 are operated, an elastic deformation of the outer cover 100 may be easily performed, and thus a pressure change due to the touch operation on each of the touching parts 161 may be further effectively transmitted to the touch sensors 310.

In addition, the plurality of touching parts 161 may be independently operated by the machining part 162. Therefore, when one of the plurality of touching parts 161 is pressed, another adjacent touching part 161 is maintained in a not-pressed state. Also, for example, when an area of the machining part 162 or the external area of the touch input part 160, instead of the area of the touching parts 161, is touched, the touching parts 161 are not pressed.

And if necessary, the touching parts 161 may be further machined in a concavo-convex shape, and may be formed so that the pressure is more effectively transmitted to the touch sensors 310 due to the concavo-convex shape.

Meanwhile, an indication part 163 which indicates the area of the touching parts 161 may be further formed at the front surface of the outer cover 100 corresponding to the touching parts 161. The indication part 163 indicates the area of the touching parts 161 by printing or laser processing, and allows the user to touch an exact position corresponding to the touch sensor 310, and thus to increase a recognition rate of the touch sensor 310.

The indication part 163 may be printed or machined in a character or pictorial form, and may be printed or machined to indicate a position corresponding to a boundary of each of the touching parts 161, and thus may guide the user to operate the exact position.

FIG. 7 is an exploded perspective view illustrating a coupling structure of the guide case, the display and the touch module according to the first embodiment of the present invention.

As illustrated in the drawing, the guide case 200 may be injection-molded using a plastic material, and the front surface thereof is formed to be inclined, the left and right side surfaces and the lower surface thereof are formed. A rear surface of the guide case 200 is opened, and formed in a rectangular shape to be in contact with the front surface of the outer plate 41.

The guide case 200 may be formed to have a shape generally corresponding to that of the outer cover 100. And the guide case 200 is formed to be in close contact with an inner side surface of the outer cover 100 when being inserted inside the outer cover 100. And the display installation part 210 and the touch module installation part 220 are formed at the front surface of the guide case 200.

The display installation part 210 is formed to have a shape corresponding to that of the display 60, and an edge thereof is formed to be stepped, such that the display 60 may be seated from a front side. And a display supporting part 211 may be further formed inside the display installation part 210 to support the display 60 at a rear side.

The touch module installation part 220 is provided under the display installation part 210, and formed to be opened corresponding to the touch module 300. At this point, an aligning groove 221 is further formed at each of left and right sides of the touch module 300. The aligning groove 221 is formed to be recessed laterally, and the left and right aligning grooves 221 are formed to be matched with aligning protrusions 322 and 331 formed at both ends of the touch module 300.

In positions of the aligning grooves 221, the aligning grooves 221 are formed so that vertical heights thereof are different from each other, and the touch module 300 may be installed in only one direction, and thus erroneous assembling of the touch module 300 may be prevented.

The aligning grooves 221 and the aligning protrusions 322 and 331 may be formed to have shapes which are matched with each other, e.g., dovetail shapes, and thus to enable the touch module 300 to be maintained in an inserted state. Therefore, the touch module 300 may be installed at a right position of the touch module installation part 220, and may be maintained at a fixed installation position.

Of course, the positions of the aligning grooves 221 and the aligning protrusions 322 and 331 may be formed reversely, and thus the aligning grooves 221 are formed at the touch module 300, and the aligning protrusions 322 and 331 may be formed at the guide case 200. The aligning grooves 221 and the aligning protrusions 322 and 331 which are provided at both of the left and right sides may be formed to have the same height but to have different sizes, and thus may be prevented from being coupled to each other in a state in which the left and right directions are reversed. And the aligning grooves 221 and the aligning protrusions 322 and 331 may be formed in other shapes which may be matched with each other.

The touch module 300 is formed to be in contact with the outer cover 100 while all of the display 60 and the touch module 300 are installed, and also formed so that other portions of the display 60 and the guide case 200 except the outer cover 100 are located on the same plane as that of the touch module 300 or located at a rear of the touch module 300. That is, when the guide case 200 and the outer cover 100 are coupled to each other, the touch module 300 may be in close contact with the rear surface of the outer cover 100 without interference with another portion of the guide case 200 or the display 60.

Meanwhile, the case coupling part 230 is formed at both of left and right sides of the rear end of the guide case 200. The case coupling part 230 extends so as to pass through the coupling hole 44 formed at the outer plate 41 and then to be inserted into the supporter coupling part 411. The guide case 200, the supporter 400 and the guide case 200 may be coupled to each other by the fastening member which is fastened from a side of the supporter 400. And the guide case 200 is formed to be coupled to the supporter 400 and thus to shield the installation opening 43 which is opened at the outer plate 41.

FIG. 8 is an exploded perspective view of the touch module according to the first embodiment of the present invention. And FIG. 9 is a perspective view of an elastic member according to the first embodiment of the present invention, when being seen from a rear thereof.

As illustrated in the drawings, the touch module 300 may include a touch PCB 320 at which the touch sensors 310 are mounted, an elastic member 330 which provides elasticity from a rear of the touch PCB 320 to the touch PCB 320, a sensor control part 340 which is attached to a rear surface of the touch PCB 320, and an adhesive sheet 350 which is attached to a front surface of the touch PCB 320.

The touch sensor 310 may be configured with a piezo type sensor which generates a change in quantity of electricity according to an input pressure change. Therefore, when the outer cover 100 is deformed by the user's touch operation, the quantity of electricity is changed according to the pressure change applied to the touch sensor 310, and the touch sensor 310 may detect an operation of the touch sensor 310 through the change in the quantity of electricity. When the touch operation on the outer cover 100 formed of the metallic material is performed, this may be effectively detected by such a characteristic of the touch sensor 310.

The touch PCB 320 is a printed circuit board at which the touch sensors 310 are mounted, and a plurality of sensor holes 321 are formed at positions corresponding to the touching parts 161 so that the touch sensors 310 are installed therein. At this point, each of the touch sensors 310 is formed in a circular shape, and each of the sensor holes 321 is formed to have a diameter slightly smaller than that of each of the touch sensors 310, and to support an edge of the touch sensor 310, and thus to enable the touch sensor 310 to be easily deformed by the pressing, thereby effectively detecting the user's touch operation. Of course, the sensor holes 321 may be holes which pass through the touch PCB 320, or may be grooves which are recessed from one surface of the touch PCB 320.

Meanwhile, the touch PCB 320 is generally formed to have a size and a shape corresponding to the touch module installation part 220. And a first aligning protrusion 322 which protrudes to be installed at the touch module installation part 220 may be formed at both of left and right side ends of the touch PCB 320.

The adhesive sheet 350 may be further provided at the front surface of the touch PCB 320. The adhesive sheet 350 serves to bond the front surface of the touch PCB 320 and the rear surface of the outer cover 100, and also serves to enable the touch sensors 310 to be maintained in a contacting state with the touching parts 161 of the outer cover 100. To this end, the adhesive sheet 350 is formed corresponding to a shape of the front surface of the touch PCB 320, and openings 351 through which the touch sensors 310 are exposed may be formed at the adhesive sheet 350.

Meanwhile, the sensor control part 340 for processing an operating signal of the touch PCB 320 is installed at the rear surface of the touch PCB 320. The sensor control part 340 is attached to the rear surface of the touch PCB 320 corresponding to an outside of the touch sensors 310 so as not to have an influence on sensitivity of the touch sensors 310, and is formed long in a transverse direction so as not to be interfered with an area of the touch sensors 310.

A PCB connector 341 is provided at one side of the sensor control part 340. The PCB connector 341 serves to supply power and transfer a signal to the touch PCB 320, and has a connector structure which may be easily connected. The PCB connector 341 may also be disposed at a space between the touch sensors 310 so as not to have an influence on the sensitivity of the touch sensors 310, and may extend long vertically.

Meanwhile, the elastic member 330 may be provided at a rear of the touch PCB 320. The elastic member 330 may be formed of a rubber, urethane or silicone material which has elasticity, and is formed to have a size and a shape corresponding to the touch PCB 320 and the touch module installation part 220.

A second aligning protrusion 331 is formed at both of left and right sides of the elastic member 330, and formed to have the same position and shape as those of the first aligning protrusion 322. Accordingly, when the touch module 300 is assembled, the first aligning protrusion 322 and the second aligning protrusion 331 form the aligning protrusions, and may be matched with the aligning grooves 221 formed at the touch module installation part 220.

An elastic member opening 332 is formed at a center of the elastic member 330. The elastic member opening 332 is opened at a position corresponding to the sensor control part 340 and the PCB connector 341 so as to have the same shape as that thereof.

When the elastic member 330 supports the touch PCB 320, the sensor control part 340 and the PCB connector 341 pass through the elastic member opening 332. Therefore, the sensor control part 340 and the PCB connector 341 are not interfered with the elastic member 330, and are not interfered with other elements either, and thus may prevent the sensitivity from being lowered due to the interference when the touch sensors 310 are operated.

The elastic member 330 is formed in a plate shape or a sheet shape, and a front surface of the elastic member 330 is formed in a flat surface, and thus may be in contact with the rear surface of the touch PCB 320. The front surface of the elastic member 330 may be coated with an adhesive, and then may be bonded to the rear surface of the touch PCB 320.

A plurality of space parts 333 are formed at a rear surface of the elastic member 330. The space parts 333 may be formed by a plurality of boundary parts 334 and partition parts 335 which protrude from the rear surface of the elastic member 330. The space parts 333 may be formed at positions corresponding to elastic parts 431 and the touch sensors 310.

Specifically, the boundary parts 334 are formed to protrude along an edge of the rear surface of the elastic member 330, and the partition parts 335 are formed to protrude between the boundary parts 334, and the plurality of space parts 333 are formed in a lengthwise direction of the elastic member 330.

The boundary parts 334 and the partition parts 335 protrude by the same heights, and are formed to be in close contact with a front surface of the supporter 400. At this point, the elastic parts 431 formed at the supporter 400 are located inside the plurality of space parts 333, respectively. And an inner side surface of each of the space parts 333 is formed to be in contact with each of the elastic parts 431.

Meanwhile, air vents 336 located on the same extension line are formed at the boundary parts 334 and the partition parts 335 to cut the boundary parts 334 and the partition parts 335. The air vents 336 serves to enable air inside the space parts 333 to be discharged when the elastic member 330 is compressed toward the front surface of the supporter 400. Accordingly, the elastic member 330 may be smoothly deformed by the pressing, and a repulsive force due to the air may be reduced, and thus the touch operation may be effectively detected.

FIG. 10 is a perspective view of the supporter according to the first embodiment of the present invention.

As illustrated in the drawing, the supporter 400 may include a base 410 which is in close contact with and fixed to a rear surface of the outer plate 41, and a protruding part 420 which protrudes forward from the base 410, passes through the installation opening 43 and supports the touch module 300.

The base 410 is formed in a quadrangular shape which is larger than a size of the installation opening 43, and the supporter coupling part 411 is formed at one side of the base 410 corresponding to the coupling hole 44 of the outer plate 41. The supporter coupling part 411 is formed in a hole shape in which the case coupling part 230 is inserted, and may be opened so that the fastening member is fastened from a rear thereof.

A perimeter of the base 410 may form a flange 412 which is bent backward, and a hook 413 may be formed at an end of the flange 412, and thus the supporter 400 may be fixed to one side of the main body 10.

A base hole 414 is formed at a center of the base 410. The base hole 414 provides a space in which one element forming the display 60, e.g., a display PCB (not shown) or a control part (not shown) is disposed.

The protruding part 420 may protrude forward from a lower portion of the base 410, i.e., a lower side of the base hole 414, and may be formed so that the front surface of the supporter 400 is in close contact with the rear surface of the touch module 300 when the supporter 400 is coupled with the guide case 200. A front surface of the protruding part 420 may be formed to have an inclined surface which is in close contact with the touch module 300 and corresponds to the shape of the outer cover 100.

And a stepped part 430 which is formed to be stepped may be further formed at the front surface of the protruding part 420. At this point, the boundary parts 334 of the elastic member 330 may be in contact along an outer perimeter of the stepped part 430, and when the supporter 400 is coupled with the guide case 200, the front surface of the supporter 400 and the elastic member 330 may be in contact with each other in such a manner that the elastic member 330 is supported by the front surface of the supporter 400.

Meanwhile, the plurality of elastic parts 431 are formed at the stepped part 430. The elastic parts 431 are formed at positions corresponding to the touch sensors 310 to provide an elastic restoring force at an area at which the touch sensors 310 are located. Therefore, the elastic member 330 may be further in close contact with the outer cover 100, and may also enable the touch sensors 310 to be easily deformed when the touch operation on the outer cover 100 is performed, and thus the recognition rate of the touch sensors 310 may be enhanced.

A cut-away part 432 formed by cutting the front surface of the supporter 400 is formed at a perimeter of each of the elastic parts 431. Therefore, the elastic parts 431 are formed to be elastically deformed backward when a pressure is applied to the elastic member 330, and then to be returned to its original position when the pressure is released. Through such a process, the elastic restoring force may be provided to the touch sensors 310 and the outer cover 100.

A contact protrusion 433 is formed at an end of each of the elastic parts 431. The contact protrusion 433 is formed to protrude forward, and may be formed at a position corresponding to a center of each of the touch sensors 310. Therefore, when the outer cover 100 is pressed, the pressure may be concentrated on a center portion of the touch sensor 310, and thus the recognition rate of the touch sensor 310 may be increased. And the elastic force may be transmitted to a side of the touch sensor 310, and the operation recognition rate of the touch sensor 310 may be further increased.

Meanwhile, a supporter opening 421 is formed at a center of the protruding part 420. The supporter opening 421 may be formed as a space in which the sensor control part 340 and the PCB connector 341 of the touch module 300 are accommodated. Therefore, even when the supporter 400 and the guide case 200 are coupled to each other, the interference between the sensor control part 340 and the PCB connector 341 may be prevented.

Hereinafter, an assembling process of the operation unit of the cooking apparatus according to the embodiment of the present invention having the above-described configuration will be described.

FIG. 11 is a perspective view illustrating a state in which the supporter is coupled to the outer plate.

As illustrated in the drawing, to assemble the operation unit 40, first, the outer plate 41 is molded. The outer plate 41 is bent so as to form a part of the exterior of the main body 10, and the installation opening 43 and the coupling hole 44 may be punched. Of course, the knob holes 42 in which the operating knobs 45 are installed may also be formed. The plurality of operating knobs 45 are rotatably installed at the plurality of knob holes 42 formed at the outer plate 41. And the touch sensor assembly 50 is disposed at a center of the outer plate 41.

The supporter 400 is installed at the outer plate 41. The supporter 400 is disposed at a rear of the outer plate 41, and formed so that the protruding part 420 passes through the installation opening 43 and protrudes forward. Also, the supporter 400 is coupled to one side of the main body 10 by the hook 413, and maintained in a fixed state.

FIG. 12 is a perspective view illustrating a state in which the display and the touch module are coupled to the guide case. And FIG. 13 is an exploded perspective view illustrating a coupling structure between the guide case and the outer cover. And FIG. 14 is an partial perspective view illustrating a coupling structure between the outer plate and the outer cover.

As illustrated in the drawings, the display 60 and the touch module 300 are installed at the guide case 200. The display 60 is installed at the display installation part 210, and the touch module 300 is installed at the touch module installation part 220.

In a state in which the display 60 and the touch module 300 are installed as described above, the front surface of the touch module 300 is in a most protruding state, and has a structure which is in close contact with the rear surface of the outer cover 100 when being coupled to the outer cover 100.

And the touch module 300 is installed so that the aligning protrusions 322 and 331 of the touch module 300 are inserted into the aligning grooves 221 of the guide case 200, and thus the touch module 300 may be exactly installed in a normal direction.

The adhesive sheet 350 is attached on the front surface of the touch module 300. The adhesive sheet 350 enables the touch module 300 and the outer cover 100 to be bonded to each other, and thus the touch module 300 and the outer cover 100 may be maintained in a primarily fixed state. At this point, the touching parts 161 of the outer cover 100 and the touch sensors 310 are bonded so as to be disposed on the same extension line, and thus the operating signal may be immediately input according to the user's touch operation on the outer cover 100.

And to couple the guide case 200 and the outer cover 100, the adhesive such as silicone may be coated on a perimeter of the guide case 200. Therefore, the guide case 200 and the outer cover 100 may be boned and further fixed to each other by the adhesive.

Also, when the guide case 200 and the outer cover 100 are coupled to each other, the coupling piece 150 of the outer cover 100 is bent inward and thus restricts a rear end of the guide case 200. The plurality of coupling pieces 150 may be arranged at regular intervals, and thus an outer surface of the outer cover 100 may be in close contact with the guide case 200 so as not to get loose from the guide case 200. That is, the coupling pieces 150 may additionally fix the outer cover 100 to the guide case 200, and thus the guide case 200 and the outer cover 100 may be maintained in a completely coupled state.

The guide case 200 coupled with the outer cover 100 is installed at the supporter 400 which is installed at the outer plate 41. At this point, the case coupling part 230 passes through the coupling hole 44, and is inserted into the supporter coupling part 411, and the supporter 400 and the guide case 200 may be coupled to each other by the fastening member which is fastened from the rear of the supporter 400.

At this point, the outer plate 41 may be fixed between the supporter 400 and the guide case 200, and the outer cover 100 is in a coupled state with the guide case 200. Of course, the display 60 and the touch module 300 are also in an installed state at the guide case 200.

The assembling of the operation unit 40 may be completed by fastening of the fastening member, and the PCB connector 341 may be connected with another connector provided in the main body, and thus may be in a state which enables supplying of the power and transmitting and receiving of the signal.

Hereinafter, an operation of the cooking apparatus as described above will be described in detail with reference to the drawings.

FIG. 15 is a cross-sectional view taken along line 15-15' of FIG. 2. And FIG. 16 is an enlarged view of an A portion of FIG. 15. And FIG. 17 is a partially cut-away perspective view of the operation unit.

As illustrated in the drawings, in a state in which the operation unit 40 is completed assembled, the supporter 400 is located inside the outer plate 41, and the guide case 200 is located inside the outer cover 100. Therefore, only the outer plate 41 and the outer cover 100 are exposed to the outside, and form the exterior of the operation unit 40.

At this point, the touch module 300 is bonded to the rear surface of the outer cover 100 by the adhesive sheet 350, and the touch sensors 310 may be maintained in a contacting state with the touching parts 161 of the outer cover 100.

The protruding part 420 of the supporter 400 provided at a rear of the touch module 300 supports the touch module 300. In particular, the stepped part 430 which further protrudes from the front surface of the protruding part 420 is in contact with the elastic member 330, and the elastic part 431 formed on the stepped part 430 is in contact with an inner side surface of each of the space parts 333 formed at the elastic member 330.

By the coupling between the supporter 400 and the guide supporter 400, the stepped part 430 of the protruding part 420 presses the elastic member 330 from a rear side thereof, and the elastic part 431 also presses the elastic member 330, in particular, an corresponding area with the touch sensor 310.

In this structure, the touching part 161 of the outer cover 100, the touch sensor 310, the space part 333 of the elastic member 330, and the elastic part 431 of the supporter 400 which are disposed on the same extension line are completely in close contact with each other.

Meanwhile, in this structure, the user touches an area of the indication part 163 formed at the front surface of the outer cover 100 to set the operation of the cooking apparatus 1. When the user touches the outer cover 100, the user may recognize an exact operating position through the indication part 163. When another position which is not the area of the indication part 163 is operated, an amount of deformation of the outer cover 100 occurring upon the touch operation is not transferred effectively to the touch sensor 310.

When the area of the indication part 163 is exactly pressed, the outer cover 100 is minutely deformed by a pressure. At this point, the deformation occurs only at the corresponding touching part 161 due to the machining part 162 of the outer cover 100, and other adjacent touching parts 161 are not deformed.

The deformation of the touching part 161 may be transferred to the touch sensor 310 which is in close contact with the touching part 161, and thus the pressure is applied to the touch sensor 310. The pressure applied to the touch sensor 310 generates a change in the quantity of electricity, and the sensor control part 340 recognizes the operating signal according to a changing value of the quantity of electricity, and then transfers information to a main control part.

Meanwhile, while the pressure is applied to the touch sensor 310, the elastic member 330 and the elastic part 431 of the supporter 400 may also receive the pressure, and thus may be elastically deformed. Therefore, when the pressure applied to the touch sensor 310 is released, the elastic member 330 and the elastic part 431 are restored to their original shapes, and also return the touch sensor 310 to its original position. Accordingly, the touch sensor 310 is maintained in the closely contacting state with the outer cover 100.

Meanwhile, the present invention may have various other embodiments other than the above-described embodiment.

A second embodiment of the present invention is characterized in that the elastic member is omitted from the touch module, and the elastic part of the supporter directly supports the touch PCB provided at the rear surface of the touch module. The second embodiment of the present invention is the same as the first embodiment except a configuration of the touch module, and like reference numerals refer to like elements and repeated description thereof will be omitted.

FIG. 18 is a cross-sectional view of an operation unit according to a second embodiment of the present invention.

As illustrated in the drawing, an operation unit 40 according to the second embodiment may include an outer plate 41 which is installed at the main body 10 and forms a part of an exterior of the main body 10, a supporter 400 which is installed inside the outer plate 41, a guide case 200 which is coupled to the supporter 400 and at which a display 60 and a touch module 300 are installed, and an outer cover 100 which is coupled to the guide case 200 and forms a part of an exterior.

A display window 111 is provided at an upper portion of the outer cover 100, and formed to check the display 60 from an outside, and a touch input part 160 which is operated by the user's touch operation is provided at a lower portion of the display window 111. And an indication part 163 which is operated by the user's touch operation may be formed on the touch input part 160.

The touch module 300 installed at the guide case 200 is in close contact with a lower portion of the outer cover 100, and a touch sensor 310 installed at the touch module 300 may be arranged at a position corresponding to the indication part 163, i.e., each of touching parts 161 provided at a rear surface of the outer cover 100. Therefore, when the user touches the indication part 163, a pressure due to the deformation of the outer cover 100 may be transferred to the touch sensor 310, and thus the user's touch operation may be detected.

Meanwhile, the touch module 300 may include a touch PCB 320 which forms a printed circuit board, the touch sensor 310 which is installed at the touch PCB 320, and a sensor control part 340 which processes a signal of the touch sensor 310.

The touch module 300 may be bonded to a rear surface of the outer cover 100 and thus may be primarily fixed, and may pressed by the supporter 400 coupled to the guide case 200, and may be in close contact with the rear surface of the outer cover 100.

The supporter 400 may include a base 410, and a protruding part 420 which protrudes from the base 410, and a stepped part 430 and an elastic part 431 may be further formed at a front surface of the protruding part 420. A cut-away part 432 is formed at at least a part of a perimeter of the elastic part 431, and thus the elastic part 431 may be elastically deformed by an external force.

The elastic part 431 is located at a rear of the touch sensor 310, and the elastic part 431, the touch sensor 310 and the touching part 161 are located on the same extension line. Therefore, when the user's touch operation is performed on the outer cover 100, the touch sensor 310 is pressed, and an operating signal is input, and the touching part 161 is pressed and slightly moved backward.

When the touch operation is completed, and the pressure applied to the touching part 161 is released, the touching part 161 is returned to the original position, and the touch sensor 310 is pushed forward, and is in close contact with the outer cover 100. As described above, the outer cover 100 is maintained in the closely contacting state with the touch sensor 310, and thus the operation recognition rate of the touch sensor 310 may be enhanced.

Meanwhile, the present invention may have various other embodiments other than the above-described embodiments.

Third and fourth embodiments of the present invention are characterized in that the touching part of the outer cover is pattern-machined, and a change in the pressure is further effectively transferred to the touch sensor when the touch operation is performed on the outer cover. The third and fourth embodiments of the present invention are the same as the first embodiment except a configuration of the touching part, and like reference numerals refer to like elements and repeated description thereof will be omitted.

FIG. 19 is a perspective view of an outer cover according to a third embodiment of the present invention.

As illustrated in the drawing, an inclined part 110 which forms a front surface of the outer cover 100 is formed to be inclined, and a display window 111 through which the display 60 is exposed is opened at an upper portion thereof, and a touch input part 170 which is operated by the user's touch operation is formed at a lower portion thereof.

A touching part 171 is formed at a rear surface of the touch input part 170. The touching part 171 is formed at a position corresponding to the touch sensor 310, and forms a portion which is operated by the user's touch operation. An indication part 163 for an exact operation of the touching part 171 may be further formed at the front surface of the outer cover 100.

Meanwhile, the touching part 171 may be defined by a machining part 172 which is formed along a perimeter of the touching part 171 by the etching or the laser processing, and may be formed so that a plurality of concentric circles having different diameters are formed. At this point, a center of the plurality of concentric circles may be formed at a position corresponding to a center of the touch sensor 310.

Therefore, when the touch operation is performed, the touching part 171 may be deformed more easily than other portions of the outer cover 100, and the pressure may be further effectively transferred to the touch sensor 310. Also, when another area which is not the touching part 171 is pressed, the pressure is not transferred to the touch sensor 310, and thus malfunction may be prevented.

FIG. 20 is a perspective view of an outer cover according to a fourth embodiment of the present invention.

As illustrated in the drawing, a touching part 181 may have other shapes other than the above-described circular shape. The touching part 181 may be formed in a spiral shape centering on a center of the touch sensor 310. In the same manner, when the touching part 181 is pressed, the outer cover 100 may be further easily deformed, and the pressure may also be further easily transferred to the touch sensor 310.

Of course, a pattern shape of the touching part 181 is not limited to the previous embodiment, and may have various structures in which a shape of the outer cover 100 may be freely deformed.

Meanwhile, the present invention may have various embodiments other than the above-described embodiments.

A fifth embodiment of the present invention is characterized in that the touch module is provided inside a separate case, and a touch booster which is interposed between the outer cover and the touch module to deliver a displacement of the outer cover generated upon the touch operation on the outer cover is further provided at the case. The fifth embodiment of the present invention is the same as the first embodiment except configurations of the case and the touch module, and like reference numerals refer to like elements and repeated description thereof will be omitted.

FIG. 21 is an exploded perspective view of an operation unit according to a fifth embodiment of the present invention.

As illustrated in the drawing, an operation unit 40 according to the fifth embodiment of the present invention may include an outer cover 100 which is formed of a metallic material and forms a part of the exterior of the cooking apparatus 1, and a touch sensor assembly 500 which is installed at the outer cover 100.

As described in the previous embodiment, a front surface of the outer cover 100 may be formed to be inclined, and an outer perimeter thereof may be formed to be bent. Through such a structure, the front surface of the outer cover 100 forms an inclined part 110 which is formed to be inclined, and thus enables the user's touch operation and the checking of the display 60 to be easily performed.

A display window 111 at which the display 60 is installed may be formed at an upper portion of the inclined part 110, and an indication part 163 which guides the user to touch an exact position may be formed at a lower portion of the display window 111. The indication part 163 may be located at a position corresponding to a position of a touch sensor 750, and may be formed by the printing or the machining.

Of courses, the outer cover 100 may be formed in a general flat surface shape, instead of the bent shape, and may form the exterior of the cooking apparatus 1. And the display 60 may also be provided as a separate element at another position.

Meanwhile, the touch sensor assembly 500 may be installed at a rear surface of the outer cover 100. The touch sensor assembly 500 may be installed at and fixed to the rear surface of the outer cover 100 by an adhesive sheet 350. At this point, a position of the indication part 163 may be disposed corresponding to a position of the touch sensor 750 of the touch sensor assembly 500.

Hereinafter, the touch sensor assembly according to the fifth embodiment of the present invention will be described in detail with reference to the drawings.

FIG. 22 is an exploded perspective view of the touch sensor assembly according to the fifth embodiment of the present invention. And FIG. 23 is an exploded perspective view of the touch sensor assembly when being seen from a rear thereof.

As illustrated in the drawings, the touch sensor assembly 500 may include a sensor housing which forms an entire external appearance, a sensor PCB 700 which is accommodated inside the sensor housing, an elastic member 720 which supports the sensor PCB 700, and a touch booster 530 which is coupled to an open front surface of the sensor housing.

Specifically, the sensor housing may include a housing cover 510 and a housing body 520 which are coupled to each other and forms a space for accommodating the sensor PCB 700.

The housing cover 510 forms a first half of the sensor housing, and a housing coupling part 511 is formed at upper and lower ends thereof so that the touch sensor assembly 500 is installed at the cover display 200. And a front surface of the housing cover 510 is exposed while the touch sensor assembly 500 is installed at an opening 512, and the housing cover 510 may be attached to the rear surface of the outer cover 100 by the adhesive sheet 350.

The opening 512 is formed at the front surface of the housing cover 510, and the touch booster 530 is installed at the opening 512. The touch booster 530 serves to deliver a displacement of the outer cover 100, which is generated when the outer cover 100 is pressed, to a touch sensor 750 which will be described below, and a detailed structure thereof will be described below.

The opening 512 is formed to have a size corresponding to a size of the touch booster 530, and also formed to be shielded by the touch booster 530 when the touch booster 530 is installed. An extension rib 517 which extends backward is formed at a perimeter of the opening 512 to be in contact with a perimeter of the touch booster 530. Therefore, when the touch booster 530 is moved forward and backward, the touch booster 530 is guided while being prevented from being inclined or rolled.

A booster supporting part 513 which is formed to protrude inward and extend backward may be further formed inside the opening 512. The booster supporting part 513 supports the perimeter of the touch booster 530 from a rear thereof while the touch booster 530 is installed, and prevents the touch booster 530 from being moved backward beyond a preset position even when a pressure is applied to the touch booster 530.

The booster supporting part 513 is formed along the opening 512, and a hook groove 514 is formed at the booster supporting part 513. The hook groove 514 is formed at a position corresponding to a hook 531 of the touch booster 530, and may be formed by cutting a part of the booster supporting part 513. Of course, the hook groove 514 may be formed separately at one side of the housing cover 510 close to the opening 512, instead of the booster supporting part 513.

The hooks 531 and the hook grooves 514 are formed at positions of both left and right sides facing each other, disposed to be vertically spaced apart from each other at regular intervals, and prevent the touch booster 530 from being leaned in one direction when the touch booster 530 is operated.

Also, the hook groove 514 is formed long in a forward and backward direction, and also formed to be moved forward and backward while the hook 531 is located inside the hook groove 514. Therefore, the touch booster 530 may be moved forward and backward by a predetermined distance while being coupled to the housing cover 510. In addition, while the touch booster 530 is assembled to the housing cover 510, a front surface of the touch booster 530 further protrudes forward than the housing cover 510. Therefore, when the touch sensor assembly 500 is attached to the outer cover 100, the touch booster 530 may be always maintained in a closely contacting state with the rear surface of the outer cover 100.

Meanwhile, a cover coupling part 516 is formed at a perimeter surface of the housing cover 510. The cover coupling part 516 is a portion which is matched with a body coupling part 521 formed at the housing body 520, and may be formed in a groove or hole shape in which the body coupling part 521 having a hook shape is hooked. At this point, the cover coupling part 516 should be formed at a position at which a plurality of elastic members 720 are uniformly compressed when the cover coupling part 516 and the body coupling part 521 are fastened.

That is, when the housing cover 510 and the housing body 520 are coupled to each other, the elastic members 720 are compressed, and thus push forward the sensor PCB 700 and the touch booster 530. Therefore, the touch booster 530 may always protrude and may be maintained in the closely contacting state with the outer cover 100, and thus may effectively detect a user's operation when the user presses the outer cover 100.

At this point, the cover coupling part 516 and the body coupling part 521 may be located at both sides of the touch sensor 750, i.e., between the elastic members 720 located at both ends of the touch sensor 750 or both sides thereof.

A wire hole 515 is formed at an upper surface of the housing cover 510. The wire hole 515 is opened so that a first cable connector 610 connected to a sensor terminal 711 installed at the sensor PCB 700 is moved in and out therethrough. The wire hole 515 may be formed at at least one of the housing cover 510 and the housing body 520.

The housing body 520 is coupled to the housing cover 510, and forms an external appearance of a second half of the touch sensor assembly 500, and a space in which the sensor PCB 700 is installed is formed therein.

A plurality of body coupling parts 521 are formed at a perimeter surface of the housing body 520 which is bent forward along a perimeter thereof. Each of the body coupling parts 521 may be formed by cutting a part of the perimeter surface of the housing body 520, and may be inserted into the cover coupling part 516 so that the housing cover 510 and the housing body 520 are maintained in a coupled state to each other.

The cover coupling parts 516 and the body coupling parts 521 are arranged at regular intervals, and disposed at the same positions of both of left and right sides to face each other, and thus coupled simultaneously with an equal force when the housing cover 510 and the housing body 520 are coupled to each other. Accordingly, the elastic member 720 is prevented from sloping during an assembling process.

Meanwhile, a wire hole 522 may be formed at an upper perimeter surface of the housing body 520. The wire hole 522 may be formed at the same position as that of the wire hole 515 of the housing cover 510, and may also be formed so that the first cable connector 610 is moved in and out therethrough.

An installation guide 523 is formed at a bottom surface of the housing body 520. The installation guide 523 serves to guide an installation of the plurality of elastic members 720, and is formed to accommodate the elastic members 720 attached to the sensor PCB 700.

Specifically, the installation guide 523 may be formed to have a shape corresponding to the sensor PCB 700, and may form a space corresponding to a transverse width of the elastic member 720. Therefore, the elastic members 720 may be located at an internal area of the installation guide 523, and both of left and right side surfaces of the installation guide 523 supports left and right ends of the elastic members 720. Therefore, while the elastic members 720 are compressed, the elastic members 720 may be stably supported so as not to be twisted or inclined in one direction.

A terminal hole 524 is opened at the bottom surface of the housing body 520 corresponding to the sensor terminal 711 provided at the sensor PCB 700. The terminal hole 524 may be formed in a shape corresponding to the sensor terminal 711, and may be formed so that the sensor terminal 711 is exposed therethrough. Therefore, even when the sensor PCB 700 is moved forward and backward, the sensor terminal 711 is not interfered with the bottom of the housing body 520.

Also, since the first cable connector 610 is coupled to a side surface of the sensor terminal 711, a coupling state between the first cable connector 610 and the sensor terminal 711 may be confirmed through the terminal hole 524.

Meanwhile, the sensor PCB 700 is supported by the elastic members 720 inside the sensor housing while a spacer 730, the touch sensor 750 and a conductive foil 740 are attached thereto. And the touch booster 530 is installed at the opening 512 to be movable forward and backward, and always maintained in the contacting state with the outer cover 100, and thus the displacement generated when a touch operation part 12 of the outer cover 100 is pressed by the user may be immediately transferred to the touch sensor 750.

FIG. 24 is a longitudinal cross-sectional view of the touch sensor assembly. And FIG. 25 is an exploded perspective view illustrating a coupling structure of the touch sensor which is a main element of the touch sensor assembly. And FIG. 26 is a plan view and a rear view of the sensor PCB which is a main element of the touch sensor assembly. And FIG. 27 is a partial perspective view illustrating a state in which a shielding member is installed at the sensor PCB.

As illustrated in the drawings, the sensor PCB 700 is formed of a plastic material, and a copper piece 712 forming a circuit is printed on a surface thereof. The touch sensor 750 which detects a pressed displacement of the outer cover 100 due to a user's touch is provided at a front surface of the sensor PCB 700.

The touch sensor 750 is configured with a piezo sensor, and more specifically, may be formed by attaching a ceramic element 752 on an upper surface of a metal plate 751. The metal plate 751 may be elastically deformed by a pressure of the user' touch operation on the outer cover 100, and the ceramic element 752 generates a change in the quantity of electricity according to the pressure. The embodiment of the present invention has been described with an example in which the touch sensor 750 is formed in the circular shape. However, the shape of the touch sensor 750 is not limited to the circular shape, and may have various shapes.

Meanwhile, a plurality of touch sensors 750 may be formed along the sensor PCB 700, and a sensor hole 713 is formed at the sensor PCB 700 at which the touch sensors 750 are installed.

The sensor hole 713 may be formed at the sensor PCB 700 corresponding to a position at which the touch sensor 750 is installed, and may be formed to pass through the sensor PCB700. The sensor hole 713 is formed to have a diameter smaller than a size of the touch sensor 750, and is also formed so that a circumference of the sensor hole 713 supports a circumference of the touch sensor 750, more specifically a circumference of the metal plate 751 from a lower side thereof.

And the sensor hole 713 may be formed at a position corresponding to the touch operation part 12 of the outer cover 100, and may be formed larger than a size of the ceramic element 752 of the touch sensor 750.

The touch sensor 750 may be installed to cover the sensor hole 713. Therefore, the circumference of the sensor hole 713 supports the circumference of the metal plate 751 from the lower side thereof, and the ceramic element 752 is not supported but may be exposed to an inside of the sensor hole 713.

Due to such a structure, when the displacement of the outer cover 100 occurs while the touch operation part 12 is operated, the displacement may be transferred to the touch sensor 750. At this point, since only the circumference of the metal plate 751 is supported, the touch sensor 750 may be further easily elastically deformed, and the pressure generated when the touch operation part 12 is touched may be concentrated on the ceramic element 752, and the touching of the touch operation part 12 may be effectively detected.

Meanwhile, a shielding member 780 is attached on a lower surface of the sensor PCB 700 at which the sensor hole 713 is formed. The shielding member 780 is formed in a film or plate shape, and formed larger than the sensor hole 713, and shields the open lower surface of the sensor hole 713. That is, an upper surface of the sensor hole 713 may be shielded by the touch sensor 750, and a lower surface thereof may be shielded by the shielding member 780. At this point, the shielding member 780 may be completely bonded to the sensor PCB 700 by an adhesive, and may air-tightly seal an inside of the sensor hole 713. Therefore, a space for elastic deformation of the touch sensor 750 may be provided, and at the same time, water or moisture may be prevented from penetrating the inside of the sensor hole 713, and thus corrosion of the touch sensor 750 may be prevented.

Meanwhile, a common contact point 714 which is connected to positive poles of the plurality of touch sensors 750 through the circuit is formed at one side of the sensor PCB 700. The common contact point 714 connects lower surfaces of the plurality of touch sensors 750, and is in contact with a conductive line 741 of the conductive foil 740 when the conductive foil 740 is bonded, and thus connected to negative poles of the plurality of touch sensors 750. Therefore, the electric power may be applied to the touch sensor 750.

An installation indicating part 715 which indicates an exact installing position of the elastic member 720 is formed at the rear surface of the sensor PCB 700. The installation indicating part 715 may be formed by the printing or the machining, and may be formed to indicate a position at which the elastic member 720 is installed.

At this point, the installing position of the elastic member 720, i.e., a position of the installation indicating part 715 is located at both of left and right sides (in FIG. 17) based on the position of the touch sensor 750. And the installing position of the elastic member 720, i.e., the position of the installation indicating part 715 is located at an outside further than an external end of the touch sensor 750. Therefore, the touch sensor 750 is not interfered by the elastic member 720, and thus detecting ability of the touch sensor 750 is not lowered. In addition, the plurality of elastic members 720 may be arranged to be spaced apart from the touch sensors 750 at a constant distance, and thus to provide the equal pressure to the sensor PCB 700.

And the positions of the plurality of touch sensors 750 may be arranged on the same extension line as that of the body coupling part 521 and the cover coupling part 516. That is, as illustrated in FIG. 14, the body coupling part 521 and the cover coupling part 516 may be located on the same extension line in left and right directions of the touch sensor 750. And the body coupling part 521 and the cover coupling part 516 may be disposed to be located between one pair of elastic members 720 close to the touch sensor 750. Therefore, the body coupling part 521 and the cover coupling part 516 are located at both of left and right sides of the touch sensor 750, and one pair of elastic members 720 are located in a direction intersecting them. All of the plurality of body coupling parts 521, cover coupling parts 516 and elastic members 720 are formed to have such an arrangement. Accordingly, the pressure may be evenly provided to the entire sensor PCB 700 located inside the sensor housing, and all of the plurality of touch sensors 750 may detect the user's operating signal under the same conditions.

FIG. 28 is a plan view of the spacer which is a main element of the touch sensor assembly. As illustrated in the drawing, the spacer 730 is attached to the front surface of the sensor PCB 700. The spacer 730 serves to bond the sensor PCB 700 with the conductive foil 740, and may be configured with an adhesive member such as a double-sided tape. The spacer 730 is formed to have a size corresponding to sizes of the sensor PCB 700 and the conductive foil 740. And the spacer 730 may be formed to have a predetermined thickness, such that the conductive foil 740 is in contact with an upper surface of the touch sensor 750 and the common contact point 714 at an appropriate height.

To this end, a spacer opening 731 is formed at a position corresponding to that of the touch sensor 750. The spacer opening 731 is formed larger than a size of the touch sensor 750, and thus the touch sensor 750 may be accommodated inside the spacer opening 731, and may allow the touch sensor 750 not to be interfered when the touch sensor 750 is operated. The number of touch sensors 750 is formed corresponding to the number of spacer openings 731, and a vent hole 732 which is cut in a predetermined length is formed at the spacer openings 731.

The vent hole 732 serves to discharge bubbles generated when the spacer 730 is attached, and is formed in a lengthwise direction of the spacer 730, and all of the vent holes 732 extend in one direction. At this time, the spacer 730 may be progressively attached in a direction that the vent holes 732 extend from the spacer opening 731.

A guide part is provided at each of the spacer 730 and the conductive foil 740 so that the spacer 730 and the conductive foil 740 are attached at exact positions.

Specifically, the guide parts are through-holes 733 and 744 which are provided at the spacer 730 and the conductive foil 740, respectively. A plurality of through-holes 733 and 744 are formed along the spacer 730 and the conductive foil 740, respectively, and may be disposed to cross each other. An operation rod 760 is disposed at positions of the sensor PCB 700 corresponding to the through-holes 733 and 744, passes through the through-holes 733 and 744, and attaches, in turn, the spacer 730 and the conductive foil 740. The spacer 730 and the conductive foil 740 may be attached at the exact position by the guide part, and may maintain an exact distance interval from the touch sensor 750 provided at the sensor PCB 700, and thus may prevent error occurrence in the plurality of touch sensors 750.

FIG. 29 is a plan view of the conductive foil which is a main element of the touch sensor assembly.

As illustrated in the drawing, the conductive foil 740 may be formed of a resin film material such as PET, and may be formed to have a size corresponding to the sensor PCB 700 and the spacer 730.

The conductive line 741 which connects upper surfaces of the plurality of touch sensors 750 and the common contact point 714 is formed at the conductive foil 740. The conductive line 741 formed of silver is printed on a lower surface of the conductive foil 740, and formed to extend, such that the lower surface on which the conductive line 741 is printed is bonded to the spacer 730 and at the same time, is in contact with the touch sensor 750 and the common contact point 714.

That is, the conductive line 741 may extend so as to intersect or connect between an outer guide line 743 and an inner guide line 742 at a center of the conductive foil 740.

The conductive line 741 formed at the conductive foil 740 is formed at the lower surface thereof in contact with the touch sensor 750, and connects the common contact point 714 with the upper surfaces of the touch sensors 750, i.e., negative poles so that the electric power is applied to the touch sensor 750.

Meanwhile, the inner guide line 742 and the outer guide line 743 which allow the touch sensors 750 to be attached to exact positions are printed on the conductive foil 740. The inner guide line 742 is formed corresponding to a size of the ceramic element 752, and the outer guide line 743 is formed corresponding to a size of the metal plate 751. Therefore, while the touch sensors 750 are installed at the exact positions, the ceramic element 752 is located at the inner guide line 742, and the metal plate 751 is located at the outer guide line 743.

A mesh 745 which includes grid-shaped lines may be further formed at an entire surface of the conductive foil 740, and when the signal is generated, a noise may be reduced by the mesh 745.

And the mesh 745 is not formed between the outer guide line 743 and the inner guide line 742, and thus, when the outer cover 100 is deformed, resistance against the deformation due to the conductive line 741 may be minimized.

FIG. 30 is a rear perspective view of the touch booster which is a main element of the touch sensor assembly.

As illustrated in the drawing, the touch booster 530 is formed to have a size corresponding to the opening 512 of the housing cover 510 and thus to shield the opening 512. And the hook 531 is formed at both of left and right ends of the housing cover 510. The hook 531 is coupled into the hook groove 514 formed at the housing cover 510, and a plurality of hooks 531 are formed at regular intervals. The hook 531 is formed to be moved forward and backward inside the hook groove 514.

A plurality of elastic deformation parts corresponding to the number of touch sensors 750 are formed at the touch booster 530. The elastic deformation parts are formed at positions corresponding to those of the indication part 163 of the outer cover 100 and the touch sensors 750, and have a structure which may be elastically deformed to be moved forward and backward. Therefore, when the user presses the indication part 163, the indication part 163 may be moved backward depending on the deformation of the outer cover 100, and may press the touch sensors 750. When a user's hand is separated from the indication part 163, the elastic deformation part is returned to its original position.

Specifically, the elastic deformation part may include a first extension part 532 which extends from one side of an open area of the touch booster 530, a second extension part 533 which extends from a position opposite to the first extension part 532, and a common part 534 which is disposed at a center thereof to be connected with the first extension part 532 and the second extension part 533.

The first extension part 532 and the second extension part 533 are formed to have a relatively narrow width, such that the common part 534 is movable, and also formed to extend in a sufficient length, to be bent at least once or more and thus to be easily elastically deformed. The first extension part 532 and the second extension part 533 may be formed to extend and to be bent along a perimeter of the common part 534, and also to be symmetric with respect to the common part 534. A remaining area except the first extension part 532, the second extension part 533 and the common part 534 is cut in the form of a spiral centering on a center of the common part 534, and thus formed as a cut-away part 536 which is cut along the perimeters of the first extension part 532, the second extension part 533 and the common part 534.

A protruding part 535 which protrudes downward is formed at a lower surface of the common part 534. The protruding part 535 is located at the center of the common part 534, and located at a position corresponding to a center of the touch sensor 750. And the protruding part 535 is formed to maintain a contacting state with an upper surface of the conductive foil 740 corresponding to the center of the touch sensor 750. Therefore, when the common part 534 is moved backward, the center of the touch sensor 750 may be pressed.

FIG. 31 is a cut-away perspective view of the operation unit. And FIG. 32 is an enlarged cross-sectional view of a B portion of FIG. 31. And FIG. 33 is a cross-sectional view illustrating a state in which the touch sensor assembly is installed.

As illustrated in the drawings, the touch sensor assembly 500 is attached to the outer cover 100. At this point, the adhesive sheet 350 is attached to a front surface of the housing cover 510 so that the touch sensor assembly 500 may be attached to the rear surface of the outer cover 100.

At this point, the adhesive sheet 350 is not provided at the touch booster 530. And the touch booster 530 is in close contact with the rear surface of the outer cover 100. To this end, when the touch sensor assembly 500 is assembled, the elastic member 720 pushes forward the sensor PCB 700, while being compressed. Therefore, the sensor PCB 700 is in close contact with the touch booster 530. The touch booster 530 is formed to be moved forward and backward while being coupled to the housing cover 510 and to protrude forward further than the front surface of the housing cover 510 by pressing of the elastic member 720.

Therefore, even though the housing cover 510 is bonded to the outer cover 100 by the adhesive sheet 350, the front surface of the touch booster 530 is maintained in the closely contacting state with the rear surface of the outer cover 100.

In this state, when the user touches the indication part 163 of the outer cover 100, the displacement occurs in the area of the outer cover 100 operated by the user, and the displacement of the outer cover 100 is immediately transferred to the touch sensor 750 through the touch booster 530 which is in completely close contact, and the touch sensor 750 is pressed, and thus the user's operation is detected. At this point, the elastic member 720 may be further compressed depending on the operating pressure, and the touch booster 530 may be slightly moved backward by the coupling between the hook 531 and the hook groove 514.

And when the user's hand is separated from the indication part 163, the sensor PCB 700 and the touch booster 530 are moved forward again by a restoring force of the elastic member 720, a restoring force of the touch booster 530 and a restoring force of the metal plate 751 of the touch sensor 750, and returned to a state before the user's operation.

The elastic member 720 which supports and presses the sensor PCB 700 may be formed in various shapes so as to provide a uniform pressure to the sensor PCB 700 when the sensor housing is coupled.

Meanwhile, the present invention may have various other embodiments other than the above-described embodiments.

A sixth embodiment of the present invention is characterized in that the touch module is installed on an exterior member forming an exterior of the upper surface of the cooking apparatus. The sixth embodiment of the present invention is the same as the first embodiment except an installation position of the touch module and a configuration of the exterior member, and like reference numerals refer to like elements and repeated description thereof will be omitted.

FIG. 34 is an exploded perspective view of a cooking apparatus according to a sixth embodiment of the present invention.

As illustrated in the drawing, a cooking apparatus 1 according to the sixth embodiment of the present invention may include a main body 10 which forms a cooking space therein, a door 20 which is provided at a front surface of the main body 10 to be opened and closed and thus to selectively open the cooking space, and a cook-top 30 which is provided at an upper portion of the main body 10 to cook food.

Specifically, the main body 10 may be formed in a hexahedral shape to form two separate cooking spaces therein. Each of the cooking spaces may be opened forward, and the door 20 is provided at each of the cooking spaces to independently open and close the cooking spaces.

An inside of the cooking space is formed to be heated by the gas or the electric power and thus to heat and cook the food accommodated therein. The cooking spaces which are respectively provided at upper and lower portions may be formed to be independently operated.

The door 20 may be rotated forward to be opened and closed, and the door 20 which opens and closes the lower cooking space may be formed in a drawer type which is slidably inserted and withdrawn.

The cook-top 30 forms an upper surface of the cooking apparatus 1, and may be formed in a flat surface shape. And the cook-top 30 is formed so that a container for cooking is seated on an upper surface thereof and then heated. The cook-top 30 may have a sealed-type gas range which is heated by the gas, or may be heated by the electric power.

An exterior member which forms an exterior of the main body 10 may be provided at the upper surface of the main body 10. And the exterior member may include an outer plate 41*a* which is provided at a front end of an upper surface of the cook-top 30.

The outer plate 41*a* may be formed in a stainless material, and forms a part or the whole of the upper surface of the cook-top 30. And the outer plate 41*a* may be formed in a plate shape, and if necessary, at least a part of a perimeter thereof may be bent, and may further form another surface other than the upper surface of the main body 10.

The operating knobs 45, the touch module 300 and the display 60 are provided at the outer plate 41*a*, and the user may easily operate the operating knob 45 and the touch module 300, and may easily confirm the display 60 from a front side of the cooking apparatus 1.

A plurality of knob holes 42 in which the operating knobs 45 are installed are formed at the outer plate 41*a*, and the operating knobs 45 may pass through the knob holes 42 and may be rotatably installed at the main body 10.

A display window 47 is formed at a center of the outer plate 41*a*, and the display 60 is exposed to an outside through the display window 47 while being installed at the main body 10, and thus the user may check the operation and the operating state of the cooking apparatus 1.

Also, an indication part 48 may be further formed at the center of the outer plate 41*a*. The indication part 48 is touched by the user to input the operation, and indicates a portion, which is touched by the user, through the printing or the laser processing.

The touch module 300 is provided at a rear surface of the outer plate 41*a* corresponding to the indication part 48. The touch sensor 310 is mounted on the touch module 300, and may be located at a position corresponding to the indication part 48 while the touch module 300 and the outer plate 41*a* are in close contact with each other.

Meanwhile, although not illustrated, an elastic part (not shown) may be further formed at the rear surface of the outer plate 41*a* which is in contact with the touch sensor 310. The elastic part may be formed at an area corresponding to the indication part 48, and may have a certain pattern or design through the laser processing or the etching, and may be elastically deformed when the outer plate 41*a* is pressed, and thus may easily transfer the user's operating pressure to the touch sensor 310.

Meanwhile, the present invention may have various other embodiments other than the above-described embodiment.

A seventh embodiment of the present invention is characterized in that the touch module is installed on an exterior member forming an exterior of the front surface of the cooking apparatus. The seventh embodiment of the present invention is the same as the first embodiment except an installation position of the touch module and a configuration of the exterior member, and like reference numerals refer to like elements and repeated description thereof will be omitted.

FIG. 35 is an exploded perspective view of a cooking apparatus according to a seventh embodiment of the present invention.

As illustrated in the drawing, a cooking apparatus 2 according to the seventh embodiment of the present invention may include a main body 10 which forms a cooking space therein, and a door 20 which is provided at a front surface of the main body 10 to be opened and closed and thus to selectively open the cooking space.

Specifically, the main body 10 may be formed in a hexahedral shape to form the cooking spaces therein. Each of the cooking spaces may be opened forward, and the door 20 is provided at each of the cooking spaces to independently open and close the cooking spaces.

An inside of the cooking space is formed to be heated by the gas or the electric power and thus to heat and cook the food accommodated therein, and may be formed to heat and cook the food using electromagnetic waves.

The door 20 may be formed to open and close the cooking space by rotation thereof, and may also be formed so that a lower end thereof is shaft-coupled to the main body 10, and a handle is provided at an upper portion thereof, and thus the user may open the cooking space by pulling the handle forward.

An operation unit 40 which controls an operation of the cooking apparatus 2 may be provided at an upper portion of the door 20. A plurality of operating knobs 45 which are rotated by the user may be provided at the operation unit 40, and an indication part 48 which is touched by the user and a display 66 which displays an operating state and a control state of the cooking apparatus 2 may be provided.

Meanwhile, an exterior member which forms an exterior of the main body 10 may be provided at the front surface of the main body 10. And the exterior member may include an outer plate 41 which forms an exterior of the operation unit 40.

The outer plate 41 may be formed in a stainless material, and may form the front surface of the main body 10 or at least one surface of the main body 10 including the front surface. And a predetermined space at which the plurality of operating knobs 45 are installed is provided at the outer plate 41.

A touch plate 41*b* may be further provided at the outer plate 41, and the touch plate 41*b* may be further included in the exterior member.

The touch plate 41*b* may be disposed between the left and right outer plates 41, and may form an exterior of the cooking apparatus 2 together with the outer plate 41. Both ends of the touch plate 41*b* may be in contact with the outer plate 41 and thus may provide an integrated exterior.

Meanwhile, if necessary, the touch plate 41*b* may be formed so that at least one end thereof is bent and forms a front surface of the cooking apparatus 2 and a part of at least one surface thereof including the front surface. Also, a perimeter thereof may be bent so as to have an inclined surface, as described in the first embodiment.

The operating knobs 45, the touch module 300 and the display 60 are provided at the touch plate 41*b*, and the user may easily operate the operating knob 45 and the touch module 300, and may easily confirm the display 60 from a front side of the cooking apparatus 2.

Specifically, a display window 47 is formed at a center of the touch plate 41*b*, and the display 60 is exposed to an outside through the display window 47 while being installed at the main body 10, and thus the user may check the operation and the operating state of the cooking apparatus 1.

Also, an indication part 48 may be further formed at the center of the touch plate 41*b*. The indication part 48 is touched by the user to input the operation, and indicates a portion, which is touched by the user, through the printing or the laser processing.

The touch module 300 is provided at a rear surface of the touch plate 41*b* corresponding to the indication part 48. The touch sensor 310 is mounted on the touch module 300, and may be located at a position corresponding to the indication part 48 while the touch module 300 and the touch plate 41*b* are in close contact with each other.

Meanwhile, although not illustrated, an elastic part (not shown) may be further formed at the rear surface of the touch plate 41*b* which is in contact with the touch sensor 310. The elastic part may be formed at an area corresponding to the indication part 48, and may have a certain pattern or design through the laser processing or the etching, and may be elastically deformed when the touch plate 41*b* is pressed, and thus may easily transfer the user's operating pressure to the touch sensor 310.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

INDUSTRIAL APPLICABILITY

According to the embodiments, since the entire exterior can be improved, and convenience in the operation input and recognition performance can be enhanced, the present invention have high industrial applicability.

The invention claimed is:

1. A cooking apparatus comprising:

a main body configured to form a cooking space;

an outer cover formed of a metallic material and configured to form a part of an exterior of the main body;

a touch module installed to be in contact with a rear surface of the outer cover, and having a plurality of touch sensors;

a guide case located at an inner surface of the outer cover, and having a touch module installation part which is opened so that the touch module is installed; and a supporter coupled to the guide case and configured to protrude toward the touch module installation part so that the touch module is in close contact with the outer cover, wherein a touching part is located at a rear surface of the outer cover, contacts the touch sensor, and is elastically deformed to transfer pressure to the touch sensor based on receipt of touch input provided by a user.

2. The cooking apparatus of claim 1, wherein the touching part is formed by machining a surface of the outer cover using etching or laser processing.

3. The cooking apparatus of claim 1, wherein the touching part is formed by machining a perimeter of the touching part, and a thickness of the touching part is formed thicker than the perimeter of the touching part.

4. The cooking apparatus of claim 1, wherein the touching part is machined and formed in a plurality of concentric circular shapes having a center corresponding to a center of the touch sensor and having different diameters.

5. The cooking apparatus of claim 1, wherein the touching part is machined and formed in a spiral shape at a position corresponding to a center of the touch sensor.

6. The cooking apparatus of claim 1, wherein an inclined part is formed at a front surface of the outer cover to be inclined, and a perimeter of the inclined part is bent so as to accommodate the touch module, and the touching part is formed at a rear surface of the inclined part.

7. The cooking apparatus of claim 1, wherein the guide case which is inserted into the outer cover formed to be bent, and is in close contact with the outer cover.

8. The cooking apparatus of claim 7, wherein an aligning groove and an aligning protrusion are respectively formed at the touch module installation part and the touch module to have shapes corresponding to each other, such that the touch module is matched at a normal position.

9. The cooking apparatus of claim 1, wherein the touch module comprises a touch PCB at which the touch sensor is installed, and a touch control part which is installed at the touch PCB to process a signal of the touch sensor, and an elastic member which elastically supports the touch PCB is further provided at one side of the touch PCB.

10. The cooking apparatus of claim 9, wherein an opening in which the touch control part is accommodated is formed at one side of the elastic member corresponding to the touch control part.

11. The cooking apparatus of claim 9, wherein a plurality of partition parts protrude from the elastic member, and a space part is formed at a position of the touching part, and an air vent which is opened to discharge air inside the space part is further formed at one side of the space part.

12. The cooking apparatus of claim 1, wherein an outer plate which forms an exterior of the cooking apparatus is provided between the guide case and the supporter, and the supporter and the guide case are coupled by a fastening member which passes, in turn, through the supporter, the outer plate and the guide case.

13. The cooking apparatus of claim 1, wherein a coupling piece which extends so as to be bent when being coupled to the guide case and to restrict an end of the guide case is formed at an end of the outer cover.

14. The cooking apparatus of claim 1, wherein the supporter comprises a base which is restricted to the outer plate; and a protruding part which passes through an installation opening formed at the outer plate and then extends, and an end of the protruding part supports the touch module.

15. The cooking apparatus of claim 1, wherein a touching part which elastically supports the touch module is further formed at a position of the supporter corresponding to the touch sensor.

16. The cooking apparatus of claim 15, wherein a cutaway part which is cut away along the touching part and provides elasticity to the touching part is formed at a perimeter of the touching part.

17. The cooking apparatus of claim 15, wherein a protrusion which protrudes toward the touch module is further formed at one side of the touching part, and the protrusion is located at a position corresponding to a center of the touch sensor.

18. The cooking apparatus of claim 1, wherein a display window through which a display for displaying an operation and setting state of the cooking apparatus is exposed is formed at the outer cover to be opened.

19. The cooking apparatus of claim 1, wherein the outer cover comprises a front surface at which the touching part is formed and which is formed to be inclined; and a side surface and upper and lower surfaces which are bent from outer ends of the front surface, and an open rear surface of the outer cover is in contact with an outer surface of the cooking apparatus, and thus shielded.

* * * * *